United States Patent [19]

Gelfand et al.

[11] 3,952,814

[45] Apr. 27, 1976

[54] IMPACT WRENCH

[76] Inventors: Mikhail Lvovich Gelfand, Yaroslarskoe shosse, 129, kv. 44, Moscow; Yakov Isaakovich Tsipenjuk, ulitsa Kirova, 5, kv. 30, Moskovskaya oblast, Solntsevo; Petr Ivanovich Podlesnykh, ulitsa Raschupkina, 12, korpus 1, kv.29, Moscow; Georgy Afanasievich Antipov, ulitsa Krasny Mayak, 3, kv. 146, Moscow; Boris Grigorievich Goldshtein, ulitsa Molodogvardeiskaya, 24, korpus 1, kv. 26, Moscow; Nikolai Stanislavovich Lavnikov, ulitsa Kustanaiskaya, 117, kv. 10, Rostov-na-Donu; Leonid Nikolaevich Teres, ulitsa 2 Koltsevaya, 61/21 Rostov-na-Donu; Ivan Ivanovich Urazhdin, ulitsa Engelsa, 52/56, kv. 18, Rostov-na-Donu; Petr Stepanovich Yakubovsky, Podshipnikovy pereulok, 12, kv. 36, Rostov-na-Donu, all of U.S.S.R.

[22] Filed: Mar. 14, 1975

[21] Appl. No.: 558,715

[52] U.S. Cl. ..... 173/93

[51] Int. Cl.[2] ..... B25D 15/00

[58] Field of Search ..... 173/93, 93.5, 15; 81/52.3

[56] References Cited

UNITED STATES PATENTS

| | | | |
|---|---|---|---|
| 2,520,920 | 9/1950 | Fosnot | 173/93.5 |
| 2,717,672 | 9/1955 | Maurer | 81/52.3 |
| 2,786,376 | 3/1957 | Roggenburk | 173/93.5 |
| 3,208,569 | 9/1965 | Adee | 173/93 |
| 3,610,344 | 10/1971 | Schoeps | 173/93.5 |
| 3,804,180 | 4/1974 | Gelfand et al. | 173/93 |

*Primary Examiner*—James A. Leppink

*Attorney, Agent, or Firm*—Haseltine, Lake & Waters

[57] ABSTRACT

An impact wrench that may be used in various industries for tightening threaded fasteners. In the impact wrench, a hammer and an anvil are coaxially mounted in a space relationship and axially movable with respect to each other. The impact wrench is provided with a device for effecting said relative axial movement of the hammer and anvil for engagement of their impact jaws, and a device for interaction of the hammer and anvil prior to the engagement of their impact jaws.

In the impact wrench, the hammer and anvil jaws are engaged over the entire height, whereby the wear of the jaws is considerably reduced, the energy of a single blow is increased, vibration as lowered and torque tightening is ensured.

24 Claims, 48 Drawing Figures

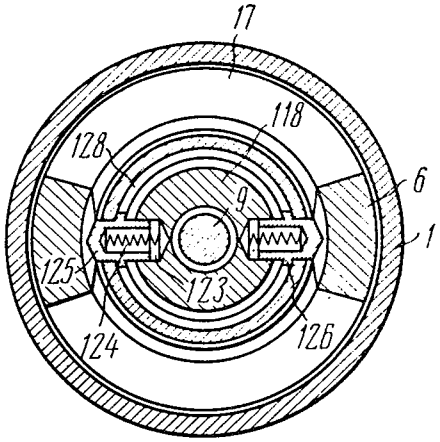
FIG. 27
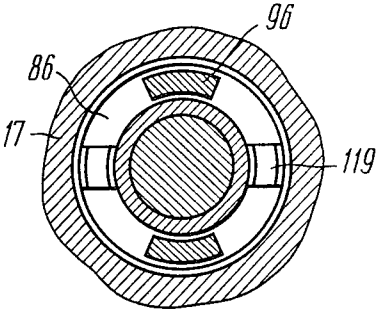
FIG. 29
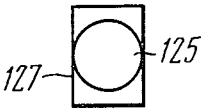
FIG. 26
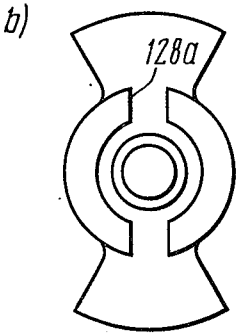
FIG. 28
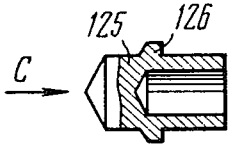
FIG. 25
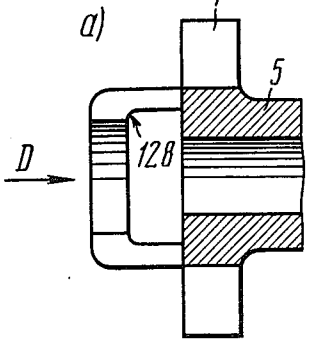

IMPACT WRENCH

The present invention relates to impact wrenches for use in mechanical engineering, as well as in automotive, ship building, construction and other industries for tightening threaded fasteners, particularly for torque tightening of critical threaded fasteners.

The amount of threaded fsteners assembled in various industries steadily increases with more stringent requirements being imposed on impact wrenches employed for tightening threaded fasteners.

An impact wrench used for tightening critical threaded fasteners must have a high specific power output (high power or impact energy to weight ratio), it should provide for a good reproducibility of the results in tightening threaded fasteners of the same type and size, be sufficiently reliable in operation and vibration proof.

Analysis of the prior art shows that a wrench complying with all the above requirements has not been developed so far.

Known in the art are impact wrenches having a centrifugal impact clutch which permits accelerating the hammer at a predetermined speed prior to delivering each blow. At a high rotational speed of the hammer prior to the blow, the impact energy, however, considerably increases, whereby, with an incomplete engagement of the impact jaws of the hammer and anvil, the impact jaws are prone to rapid wear.

Furthermore, in such impact wrenches, the impact jaws are also worn during the disengagement of the impact jaws of the hammer and anvil which results in an excessive vibration of the housing due to repeated impact at the hammer and anvil jaws.

Also known in the art is an impact wrench comprising a hammer connected to an output shaft of the drive and mounted in an axial bore of a spindle which is rigidly connected to the anvil, the anvil having an impact jaws and the hammer having a spring-loaded flyweight cooperating with the impact jaw of the anvil after the hammer gains a predetermined rotational speed (cf. U.S. Pat. No. 2,786,376, Cl. 173-93.5).

A disadvantage of this impact wrench consists in that the movement of the flyweight for engagement with the impact jaw of the anvil occurs at a low speed compared with the high rotational speed of the hammer relative to the stationary anvil since the flyweight has to overcome the resistance offered by static friction and spring. For that reason, a blow may be transmitted with an incomplete engagement of the flyweight and the impact jaw of the anvil thereby resulting in rapid wear of these parts. This considerably restricts the impact energy. In addition, due to unstable operation of the impact clutch because of variable amount of engagement of the impact jaws, the impact energy varies over a large range so that torque tightening of threaded fasteners is impossible.

There is known still another impact wrench comprising a drive shaft, a hammer with impact jaws mounted for axial displacement, an anvil with impact jaws, a spring mounted between the hammer and anvil, and flyweights comprising balls disposed between the drive shaft and a tapered surface of the hammer (cf. USSR Inventor's Certificate No. 139,256; Cl.B 25b 21/02). In this wrench, the balls cause the hammer to move towards the anvil after the hammer gains a predetermined speed for engagement of the hammer jaws with the anvil jaws. During the displacement of the hammer, the spring is compressed, then the spring disengages the hammer from the anvil.

A disadvantage of this wrench also resides in that its construction cannot eliminate incomplete engagement of the impact jaws of the hammer and anvil due to a low speed of movement of the hammer towards the anvil (due to a resistance offered by the spring) as compared to the rotational speed of the hammer, whereby the impact jaws are rapidly worn out.

Attempts have been made to reduce the wear of impact jaws of the hammer and anvil during the disengagement of the hammer and anvil after the blow transmmission.

Thus, known in the art is an impact wrench comprising a drive shaft, an axially movable hammer with impact jaws, an anvil with impact jaws, flyweights comprising rocking levers mounted on the drive shaft for moving the hammer towards the anvil at a predetermined rotational speed of the hammer, and a device for disengaging the hammer and anvil (cf. British Pat. No. 531,797; Cl. B3N). In this wrench there is no spring, and the device for disengaging the hammer and anvil has V-shaped grooves on the drive shaft, V-shaped recesses in an axial bore of the hammer and balls received in the V-shaped grooves and recesses. The elimination of spring contributes to a rapid disengagement of the hammer from the anvil due to the fact that the resistance to the backward movement of the hammer is relatively low. This construction eliminates repeated impacts of the hammer and anvil jaws.

However, with this construction of an impact wrench there is a possibility that a blow can be transmitted in the case of an complete engagement of the impact jaws of the hammer and anvil due to each of their mutual orientation prior to the blow transmission and low speed of movement of the hammer towards the anvil which results in rapid wear of the impact jaws and limits the impact energy.

Also known in the art are impact wrenches with a centrifugal impact clutch, wherein impact jaws of the hammer comprise flyweights articulated on pivots in the hammer for cooperation with the impact jaws of the hammer at a predetermined speed thereof (cf. U.S. Pat. No. 2,520,920; Cl.173-93.5).

Disadvantages inherent in the impact wrenches of such a construction consist in that the possibility of blow transmission with incomplete engagement of the impact jaws of the hammer and anvil is not eliminated as well as in that the pivotable connection of the impact jaws to the hammer is rather unreliable, especially from the viewpoint of high dynamic loads at the instant of blow transmission.

All the above-described impact wrenches with a centrifugal impact clutch cannot be used for torque tightening of threaded fasteners due to unstable impact energy, and in addition, they have an excessive vibration of the housing due to a high blow frequency.

There is known yet another impact wrench comprising a hammer with impact jaws, an axially movable anvil mounted on a spindle and urged by a spring towards the hammer and a locking device providing for a space between the impact jaws of the hammer and anvil (cf. U.S. Pat. No. 3,804,180; Cl.173-15).

In this wrench, the locking device has members positioned at a certain angle with respect to the impact jaws of the hammer and anvil, whereby their complete engagement is ensured after releasing the locking device when the hammer gains a predetermined rotational speed. With such a construction, the blow transmission with incomplete engagement of the impact jaws of the hammer and anvil is eliminated thereby considerably reducing wear; the energy of each blow is stabilized thus enabling torque tightening of threaded fasteners; the housing vibration is completely eliminated.

However, while operating such an impact wrench, the operator should exert a pressure to the housing thereof before the transmission of each blow for releasing the locking device, i.e. the wrench cannot operate in an automatic cycle for delivering sequence of blows. In addition, the operator should make it certain that the hammer has gained a predetermined rotational speed.

The principal object of the invention is to provide an impact wrench of a construction that would ensure high impact energy in an automatic cycle of operation with minimum wear of the impact clutch components.

Another object of the invention is to provide an impact wrench having high impact energy with minimum vibration of the housing.

Still another object of the invention is to provide an impact wrench having high impact energy with a maximum power-to-weight ratio.

A further object of the invention is to provide an impact wrench having stable impact energy so as to ensure torque tightening of critical threaded fasteners.

Finally, it is an object of the invention to provide an impact wrench of a compact construction with minimum weight and high reliability in operation.

With these and other objects in view in an impact wrench comprising a housing accommodating a hammer and an anvil which are mounted coaxially in a spaced relationship and axially movable with respect to each other, a drive having an output shaft connected to said hammer, the hammer having impact jaws which engage those of the anvil upon said relative axial movement to transmit a torque to the anvil, a spindle having a device for receiving a socket wrench, the spindle being connected to the anvil for rotation together therewith, a device for said relative axial movement of the hammer and anvil for engagement of their impact jaws, and a device for disengaging the impact jaws of the hammer and anvil, according to the invention, there is provided a device for interaction of the hammer and anvil prior to the engagement of their impact jaws comprising two parts axially movable with respect to each other, of which the first part is disposed in the hammer and the second part is disposed in the anvil, both parts having members engaging each other upon the relative axial movement of the parts so as to provide for preliminary interaction of the hammer and anvil, the members of the first and second parts being located at the same angle with respect to the impact jaws of the hammer and anvil, respectively, whereby, upon the preliminary interaction of the hammer and anvil, their impact jaws engage each other as they are mutually oriented.

The device for preliminary interaction of the hammer and anvil permits positioning their impact jaws in such a manner relative to each other that their engagement is over the entire height thereof, whereby the wear of impact jaws is considerably reduced, the impact energy is increased and the vibration of the housing is lowered, while ensuring torque tightening of threaded fasteners.

In the case of the hammer being made composite of a driven and a driving parts of which the driven part is mounted for rotation together with the driving part and for axial displacement towards the anvil in the impact wrench according to the invention, the first part of the device for preliminary interaction of the hammer and anvil includes the driven part of the hammer embracing the output shaft of the drive, the free end of the output shaft being journalled in an axial bore of the anvil.

The invention is further characterized in that, in the first part of the device for preliminary interaction of the hammer and anvil, the driven part of the hammer is spring-loaded with respect to the driving part thereof and has longitudinally extending recesses of rectangular cross-section receiving flyweights comprising flat elongate members of rectangular cross-section which are retained in these recesses by means of radially inwardly directed projections of the driven part of the hammer, said flyweights having, at the ends which are remote from the anvil, a tapered surface cooperating with that of the driving part of the hammer, and accommodating at the opposite ends facing the anvil the impact jaws of the hammer having projections with a tapered surface, the second part of the device for preliminary interaction of the hammer and anvil comprises a cam surface disposed at the inner side of the impact jaws of the anvil, said cam surface and the tapered surface of the impact jaws of the hammer constituting the members engaging each other upon the displacement of the first part of the device for preliminary interaction of the hammer and anvil towards the second part thereof, a spring-loaded bush being mounted on the output shaft of the drive, said bush having a flange received in notches provided on the sides of the flyweights facing the output shaft of the drive, whereby both impact jaws of the hammer concurrently engage the impact jaws of the anvil.

Such an embodiment provides for an impact wrench of a simple construction having a high impact energy to weight ratio with a high impact energy stability.

The invention is also characterized in that the driving part of the hammer is provided, at the end facing the anvil, with axial projections received in the longitudinally extending recesses of the driven part of the hammer, said tapered surface of the driving part of the hammer being provided on these projections. This permits of simplying the construction of the wrench and reducing its size.

The invention is further characterized in that there is provided, between the driving part of the hammer and the first part of the device for preliminary interaction of the hammer and anvil, a mechanism for axial displacement of the first part of the device for preliminary interaction of the hammer and anvil towards the second part thereof.

Further, the invention is characterized in that, in the first part of the device for preliminary interaction of the hammer and anvil, the driven part of the hammer is spring-loaded with respect to the driving part of the hammer and provided with a sleeve mounted therein for rotation together therewith and for axial displacement relative thereto, said sleeve accommodating impact jaws of the hammer and being retained from axial displacement by means of spring-loaded locking members mounted in radial bores of the driven part of the hammer, the sleeve having pushers mounted in radial bores of the sleeve opposite to the locking members, the second part of the device for preliminary interaction of the hammer and anvil comprising a tubular member embracing the output shaft and having axial projections axially arranged between the impact jaws of the hammer and anvil, the mechanism for displacement of the first part of the device preliminary interaction of the hammer and anvil comprising cylindrical rods extending in parallel with the output shaft within longitudinally extending recesses of the driven part of the hammer and bearing against tapered surfaces provided on the ends of the driving part of the hammer and sleeve facing each other, the axial projections of the tubular member and pushers of the sleeve constituting the members engaging each other upon the displacement of the first part of the device for preliminary interaction of the hammer and anvil towards the second part thereof.

Such an embodiment provides for a more powerful wrench having a simple construction, high stability of impact energy and a small outer diameter.

The invention is also characterized in that said device for disengaging the impact jaws of the hammer and anvil is disposed between the sleeve and the anvil and comprises a return spring embracing the tubular member and having one end bearing against the anvil and the other end received in a counter bore of the end wall of the sleeve facing the anvil.

The invention is further characterized in that, in the first part of the device for preliminary interaction of the hammer and anvil, the driven part of the hammer has radial bores, spring-loaded balls which are received in these radial bores and in an annular groove of the driving part of the hammer, which is made opposite to the radial bores, and spring-loaded locking members mounted in other radial bores of the driven part of the hammer, the second part of the device for preliminary interaction of the hammer and anvil comprises an annular projection disposed on the anvil embracing the output shaft of the drive and having axial cams axially disposed between the impact jaws of the anvil and spring-loaded locking members of the driven part of the hammer, the locking members and the axial cams constituting the members engaging each other upon the displacement of the first part of the device for preliminary interaction of the hammer and anvil towards the second part thereof, and the mechanism for displacement of the first part of the device for preliminary interaction of the hammer and anvil towards the second part thereof comprises cylindrical rods, one end of each rod bearing against the driving part of the hammer and the other end bearing against a tapered surface of the driven part of the hammer.

Such an embodiment provides for a simpler construction of the wrench in addition to its main advantages when used for assembly operations in series production.

The invention is also characterized in that, in the first part of the device for preliminary interaction of the hammer and anvil, the driven part of the hammer has an axial bore in which there is mounted an axially movable tubular member embracing the output shaft of the drive, and there is provided, between the tubular member and the driven part of the hammer, a device for axial displacement of the driven part of the hammer towards the anvil for engagement of their impact jaws, said device comprising V-shaped grooves on the periphery of the tubular member, V-shaped recesses on the inner surface of the driven part of the hammer, and balls received in the V-shaped grooves and recesses, the V-shaped grooves and recesses being located at the same angle with respect to the impact jaws of the hammer as the members of the first part of the device for preliminary interaction of the hammer and anvil.

Such an embodiment provides for a positive displacement of the hammer into engagement with the anvil along a predetermined path so as to improve the durability of the wrench and impact energy stability.

The invention is further characterized in that the driven part of the hammer is provided with spring-loaded locking members preventing the tubular member from engaging the second part of the device for preliminary interaction of the hammer and anvil, the tubular member having, at the end thereof facing the anvil, axial projections and, at the other end, a tapered surface, the second part of the device for preliminary interaction of the hammer and anvil comprises an annular projection disposed on the anvil and embracing the output shaft, said projection having axial cams axially disposed between the impact jaws of the anvil and locking members, and the mechanism for displacement of the first part of the device for preliminary interaction of the hammer and anvil comprises balls disposed between the driving part of the hammer and the tapered surface of the tubular member, the axial projections of the tubular member and locking members together with the axial cams of the annular projection constituting the members engaging each other upon the displacement of the first part of the device for preliminary interaction of the hammer and anvil towards the second part thereof.

The invention is characterized in that the second part of the device for preliminary interaction of the hammer and anvil comprises an axially movable bush having axial cams and mounted in an axial bore of the anvil for rotation together therewith, permanently springly urged towards the hammer and has radial bores as well as spring-loaded locking means mounted in these bores, the tubular member has axial projections for engaging the axial cams of the bush, the impact jaws of the hammer are provided with a tapered portion at the inner side thereof for cooperation with the locking members, and the mechanism for displacement of the first part of the device for preliminary interaction of the hammer and anvil comprises balls disposed between the driving part of the hammer and driven part of the hammer.

According to the invention, said device for disengaging the impact jaws of the hammer and anvil is disposed between the driven part of the hammer and the anvil and comprises a return spring embracing the output shaft of the drive.

According to the invention, the hammer is made composite of a driven part and a driving part of which the driven part is mounted for rotation together with the driving part and for axial displacement towards the anvil, and the driving part comprises a hollow cylindrical body embracing the anvil and journalled with the ends thereof in bearings fixed in the housing, said cylindrical body having a radial bore accommodating a spring-loaded locking member retaining the driven part of the hammer, and the driven part of the hammer is provided with a radial bore opposite to said locking member receiving a pusher which partially projects therefrom under the action of said locking member, and with an axial bore in which there is mounted the first part of the device for preliminary interaction of the hammer and anvil comprising an axially movable rod with a flange at one end and a longitudinally extending recess at the other end adjacent to the anvil, and a lever extending along the rod within the longitudinally extending recess thereof, said lever being articulated to the rod at the intermediate portion thereof, one arm of the lever engaging the pusher projecting from the radial bore of the driven part of the hammer in such a manner that the other arm of the lever projects from the longitudinally extending recess of the rod, and this arm is provided with a projection having a tapered portion at the side facing the anvil, the second part of the device for preliminary interaction of the hammer and anvil being disposed at the inner side of one of the impact jaws of the anvil and comprising a convex portion having tapered surfaces, the tapered surfaces of the lever projection and convex portion of the anvil jaw, respectively, constituting the members engaging each other upon the displacement of the first part of the device towards the second part thereof, the mechanism for displacement of the first part of the device for preliminary interaction of the hammer and anvil towards the second part thereof comprises rocking flyweights disposed in the driving part of the hammer and cooperating, upon rocking, with the flange of the rod, the device for axial displacement of the driven part of the hammer for engagement of the impact jaws of the hammer and anvil comprises a spring disposed between the flange of the rod and driven part of the hammer, and the device for disengaging the impact jaws is disposed between the flange of the rod and the driving part of the hammer and comprises a return spring.

Such an embodiment provides for a highly efficient impact wrench in which the hammer is brought into engagement with the anvil with minimum energy losses so that the overall efficiency of the wrench is improved.

In an impact wrench, wherein the drive comprises an electric motor having a rotor embracing the stator mounted on a fixed axle journalled in an axial bore of the anvil, and the hammer is made composite of a driving part rigidly connected to the rotor and a driven part axially movable to the driving part, according to the invention, the first part of the device for preliminary interaction of the hammer and anvil comprises an axially movable sleeve mounted between the fixed axle and the driven part of the hammer and having radial bores with a ball in each bore and a flange with a tapered surface facing the electric motor, the second part of the device for preliminary interaction of the hammer and anvil comprises a tubular member which is fixed in the axial bore of the anvil and has axial projections, the axial projections and the balls constituting the members engaging each other upon the displacement of the first part of the device for preliminary interaction of the hammer and anvil towards the second part thereof, the driven part of the hammer is connected to the driving part thereof by means of spring-loaded locking members mounted in radial bores of the driving part of the hammer opposite to the radial bores of the sleeve, the locking members cooperating with the balls through pushers mounted in radial bores of the driven part of the hammer, the mechanism for displacement of the first part of the device for preliminary interaction of the hammer and anvil towards the second part thereof is disposed between the driving part of the hammer and the tapered surface of the sleeve, said mechanism comprising flyweights, the device for displacement of the driven part of the hammer for engagement of the impact jaws comprises a spring disposed between the flange of the sleeve and the driven part of the hammer, and the device for disengaging the impact jaws of the hammer and anvil comprises a return spring disposed between the flange of the sleeve and the driving part of the hammer.

Such an embodiment provides for an impact wrench with a very high impact energy operating in an automatic cycle and having a relatively simple construction.

Further, the invention is characterized in that the wrench is provided with a switch for deenergizing the electric motor prior to the engagement of the impact jaws of the hammer and anvil, the switch being mounted in a bore of the fixed axle and cooperating with an internal chamfered surface of the sleeve.

The invention is further characterized in that the anvil is mounted on the spindle for axial displacement towards the hammer for engagement of their impact jaws, and the second part of the device for preliminary interaction of the hammer and anvil comprises a spring-loaded bush mounted in an axial bore of the spindle, connected to the anvil for axial displacement together therewith towards the hammer and having axial projections on the end thereof facing the first part of the device for preliminary interaction of the hammer and anvil, and the first part of the device comprises a tubular member urged by a spring towards the anvil and has axial projections for engaging the axial projections of the bush upon the displacement of the first part of the device towards the second part thereof, the tubular member being mounted in an axial bore of the hammer for axial movement and retained therein for rotation together with the hammer by means of spring-loaded locking members preventing the tubular member from axial displacement towards the anvil until the hammer gains a predetermined rotational speed, the device for axial displacement of the anvil towards the hammer for engagement of their impact jaws being disposed between the spindle and bush and comprising V-shaped grooves on the periphery of the bush, V-shaped recesses on the inner surface of the spindle and balls received in the V-shaped grooves and recesses.

Such an embodiment provides for an impact wrench with a compact device for preliminary interaction of the hammer and anvil.

According to the invention, the locking members are mounted in radial bores of the hammer and comprise flyweights urged by a spring towards the rotational axis of the hammer, the ends of the flyweights being received in recesses of the tubular member, the bush is loosely mounted on an axle journalled in an axial bore of the spindle and is provided with an annular shoulder on the outer surface thereof, and the anvil has radially inwardly directed projections cooperating with the annular shoulder of the bush, the spindle having elongated holes through which the anvil projections pass, and the device for disengaging the impact jaws of the hammer and anvil comprises a return spring disposed between the axle and an internal annular shoulder of the bush.

A shock-absorbing spring is preferably mounted between the radial projections of the anvil and the bush.

According to the invention, the hammer comprises a hollow cylindrical body extending along the rotational axis of the hammer and embracing the anvil and an annular member rigidly fixed in the cylindrical body and having impact jaws at the end wall thereof facing the anvil, the ends of the cylindrical body being journalled in bearings fixed in the housing.

According to the invention, the annular member has radial bores in which there are mounted locking members and an axial bore accommodating a tubular member, the bush has a shank received in the axial bore of the spindle and an annular shoulder on the preiphery, and the anvil has an annular projection directed radially towards the rotational axis of the hammer and longitudinally extending projections, the spindle having longitudinally extending slots for receiving the longitudinal projections, of the anvil and the device for disengaging the impact jaws of the hammer and anvil comprises a return spring disposed between the shank of the bush and the spindle.

Such an embodiment provides for compactness of the impact wrench and high impact energy.

A shock-absorbing spring is preferably mounted between the annular shoulder of the bush and an annular projection of the anvil.

According to the invention, the tubular member has longitudinal recesses on the periphery thereof positioned at a certain angle relative to the axial projections thereof, and cylindrical rods mounted in the longitudinal recesses urged outwards by a spring mounted in a diametrical bore of the tubular member and engaging the inner surface of the annular member, the angular length of the axial projections of the tubular member and bush, as well as the angular length of the impact jaws of the hammer and anvil being selected such that the axial projections of the tubular member engage the axial projections of the bush through an angle distance providing their complete engagement.

According to the invention, the hammer is made composite and comprises a driving part formed by a hollow cylindrical body extending along the housing and embracing the anvil, the ends of the cylindrical body being journalled in bearings fixed in the housing, an annular member rigidly fixed in the end of the cylindrical body remote from the anvil, and a driven part of the hammer with impact jaws mounted in the cylindrical body for axial movement and for rotation together therewith, the first part of the device for preliminary interaction of the hammer and anvil comprises the driven part of the hammer and an axially movable tubular member mounted in the driven part of the hammer and having axial projections at the end facing the anvil and a shank at the opposite end which is received in the bore of the annular member, and there is provided a mechanism for displacement of the first part of the device for preliminary interaction of the hammer and anvil towards the second part thereof comprising balls disposed between the driven part of the hammer and the annular member, the device for axial displacement of the driven part of the hammer towards the anvil for engagement of the impact jaws comprising balls and V-shaped grooves and recesses made in the tubular member and driven part of the hammer, respectively, the vertices of the V-shaped grooves and recesses being located at the same angle to the impact jaws of the hammer as the axial projections of the tubular member, the second part of the device for preliminary interaction of the hammer and anvil comprises an axially movable rod having axial projections facing the tubular member, the rod being mounted in an axial bore of the spindle, spring-loaded towards the tubular member and connected to the spindle for rotation together therewith, spring-loaded locking members mounted in a radial bore of the rod and preventing it from axial displacement, pushers mounted in radial bores of the anvil opposite to the locking members and tapered surfaces on the inner side of the impact jaws of the hammer for cooperation with the pushers, the axial projections of the tubular member and rod, respectively, constituting the members engaging each other upon the displacement of the first part of the device for preliminary interaction of the hammer and anvil towards the second part thereof, and the device for disengaging the impact jaws of the hammer and anvil comprises a return spring mounted between the shank of the tubular member and the annular member of the hammer.

According to the invention, the rod has a longitudinally extending hole receiving a pin fixed to the spindle.

The driving part of the hammer is preferably connected to the output shaft by means of a friction clutch.

Therefore, the impact wrench according to the invention has a high and stable impact energy, is vibration proof and provides for torque tightening of threaded fasteners operating in an automatic cycle. In addition, the wrench has a spindle and reliable construction.

The wrench according to the invention can be used for torque tightening of threaded fasteners. During the torque tightening of threaded fasteners, the operator transmits into a threaded fastener a predetermined number of blows and deenergizes the wrench. It should be noted that due to a low frequency of blows, counting the number of blows presents no problem.

An important advantage of the impact wrench according to the invention is a high impact energy to weight ratio which permits of providing a light-weight wrench for tightening high-tensile threaded fasteners of a large diameter.

Another important advantage of the impact wrench according to the invention is its immunity to vibration safety, as well as practically total absence of unhealthy high-frequency noise which is inherent in conventional impact wrenches.

All the above-mentioned advantages have made it possible to develop an electric impact wrench with double insulation, built around a commutatot motor which has a weight of 5 kg and a power input of 350 W and provides for an impact energy of 25 J with a maximum torque of up to 700 Nm. This impact wrench may be used for tightening critical threaded fasteners of the strength classes from 3.6 to 6.6 of a diameter of up to 30 mm and strength classes from 6.8 to 14.9 of a diameter of up to 20 mm.

In another embodiment, an electric impact wrench which weighs 4.0 kg and has a power input of 220 W provides for an impact energy of up to 16 J with a maximum torque of up to 450 Nm.

The use of impact wrenches according to the invention permits to substantially improve the quality of tightening critical threaded fasteners and solves to the problem of vibration and noise safety. In operation with such wrenches, the fatique of the operator is considerably reduced, and labour productivity increases.

The invention will now be described in greater detail with reference to specific embodiments thereof, taken in conjunction with the accompanying drawings, in which:

FIG. 25 is a general view of the locking member;

FIG. 26 is a view taken along arrow C of FIG. 25;

FIG. 27 is a sectional view taken along line XXVII—XXVII of FIG. 20;

Figure 20:
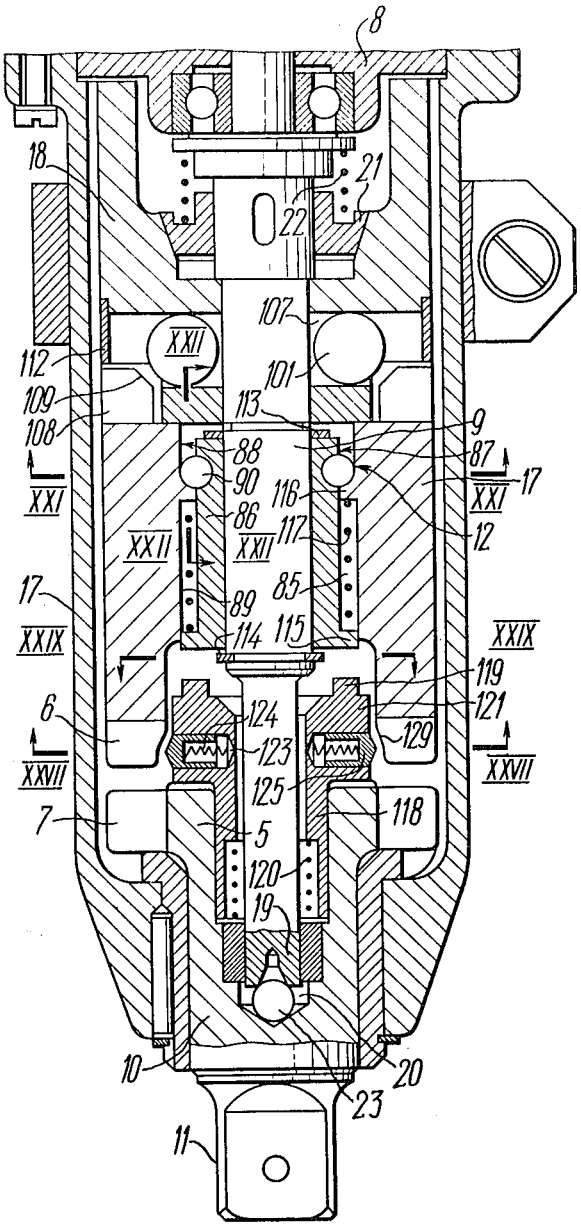
FIG. 20 is a partial longitudinal section of a fifth embodiment of the impact wrench.
Figure 21:
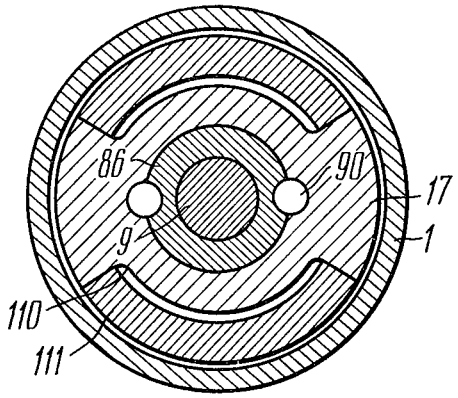
FIG. 21 is a sectional view taken along line XXI—XXI of FIG. 20.
Figure 30:
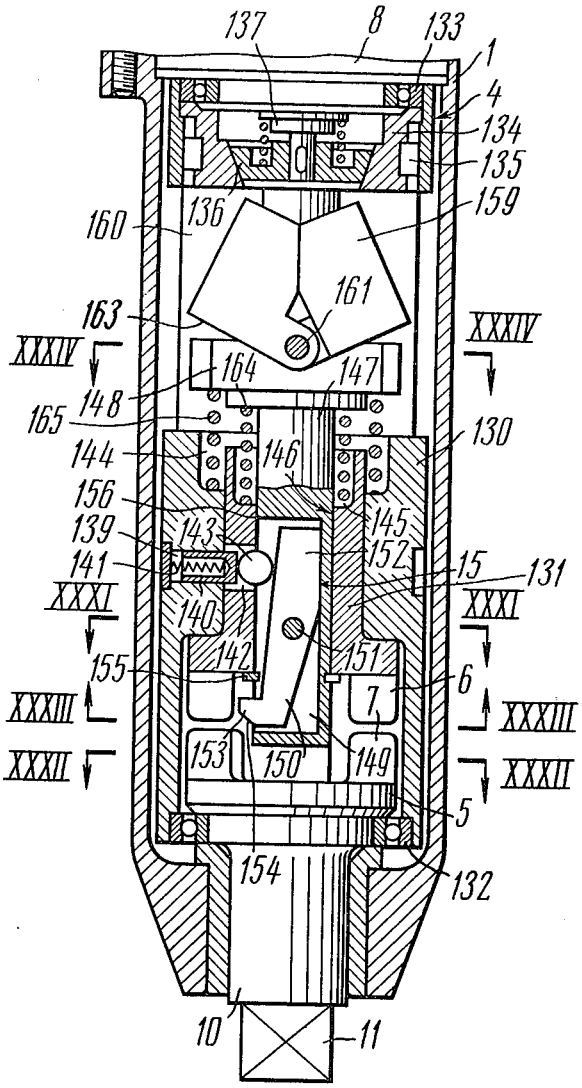
Figure 31:
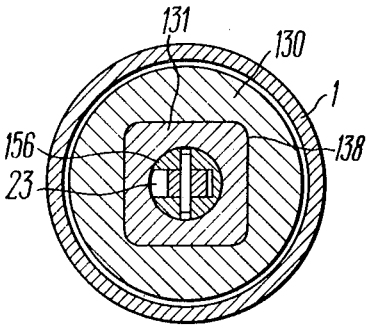
Figure 32:
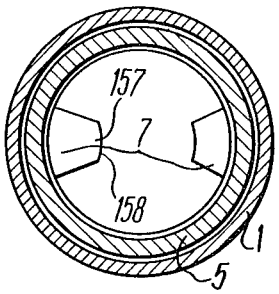
Figure 33:
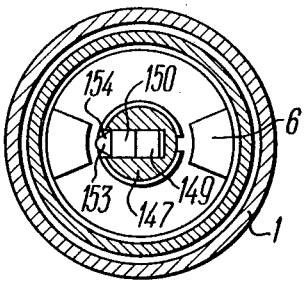
Figure 34:
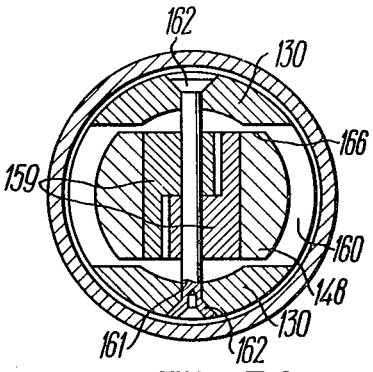
Figure 35:
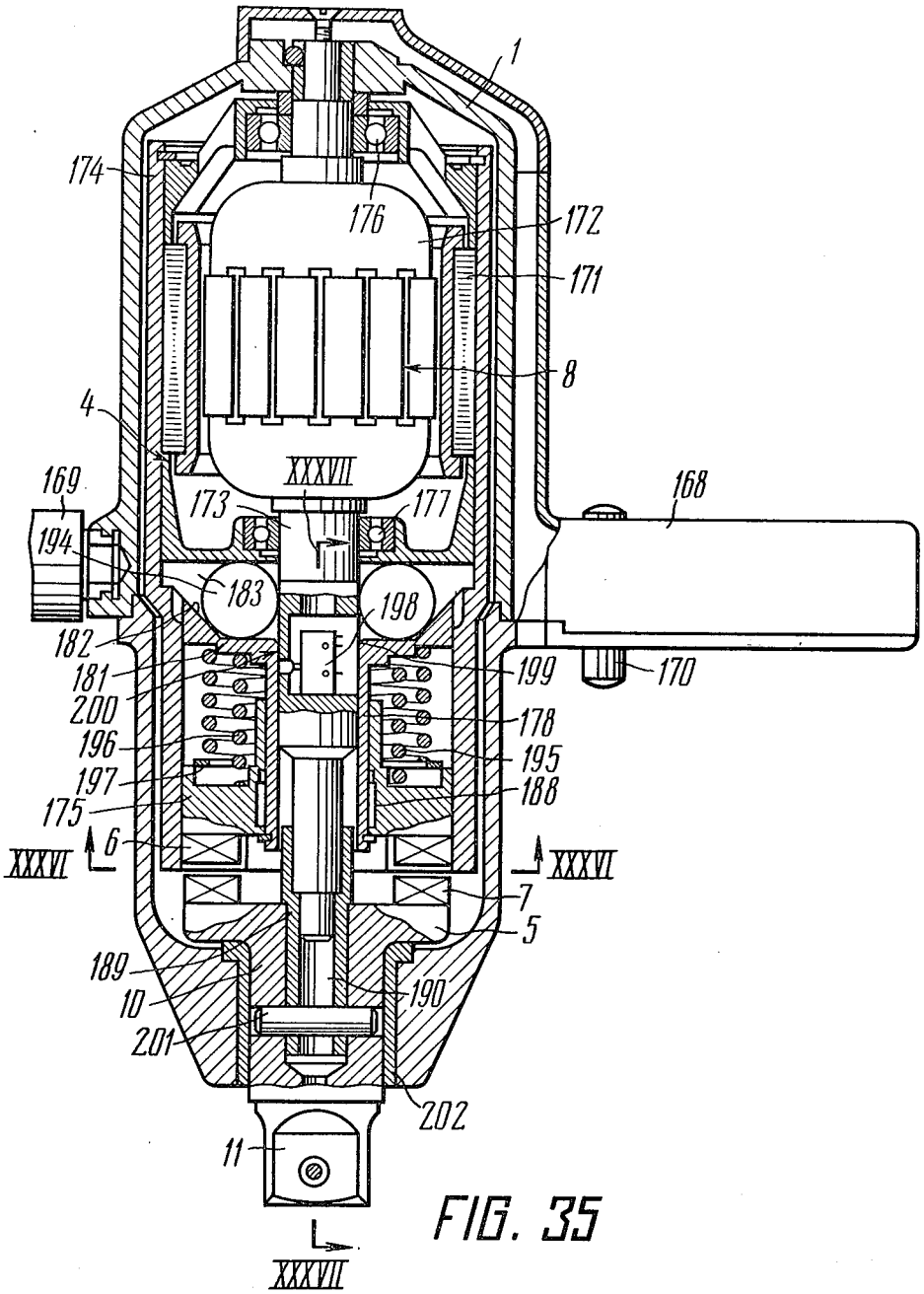
Figure 37:
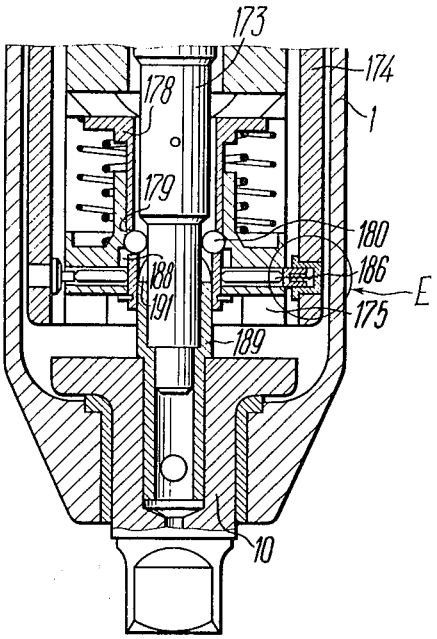
Figure 38:
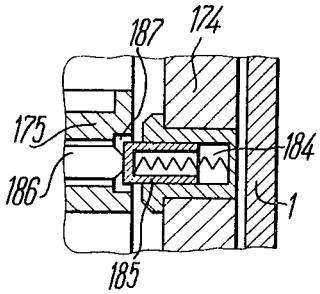
Figure 39:
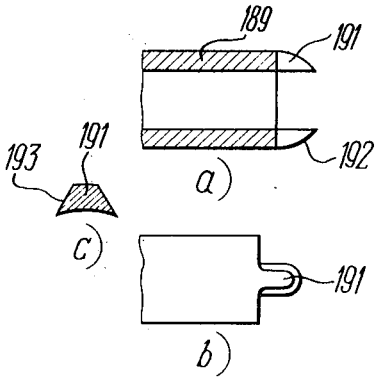
Figure 36:
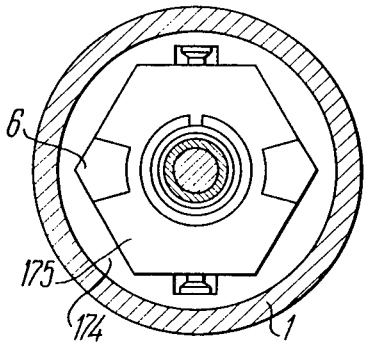
Figure 40:
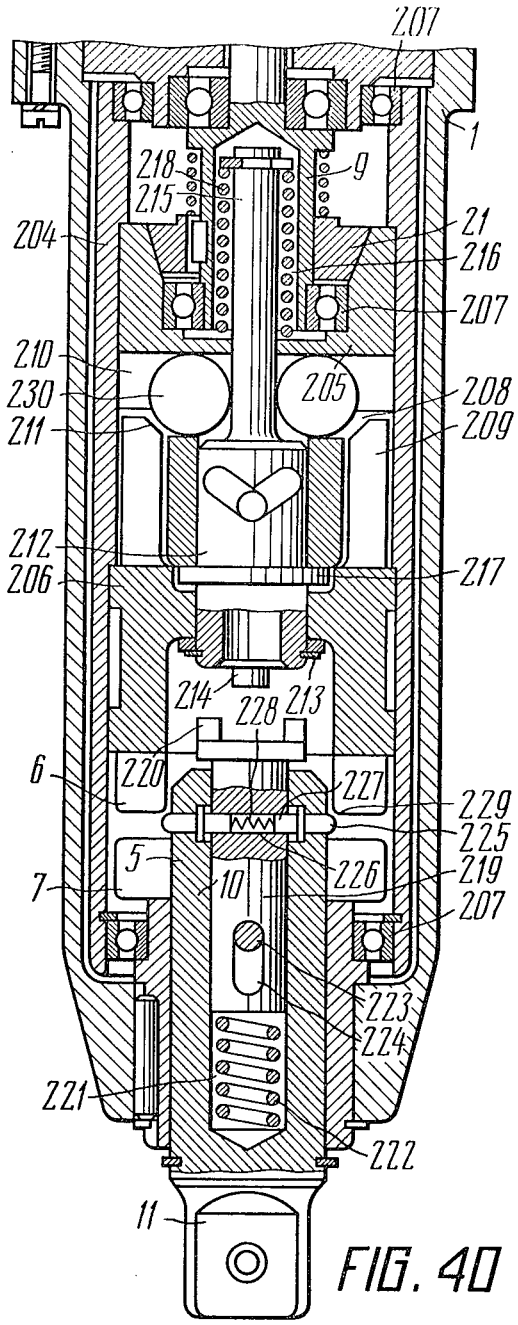
Figure 41:
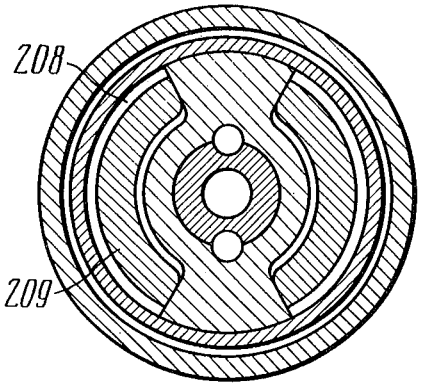
Figure 44:
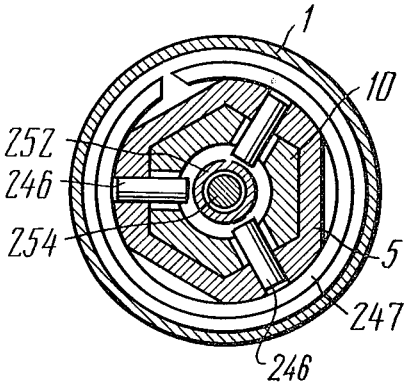
Figure 42:
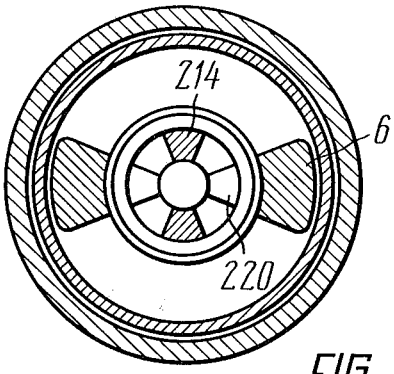
Figure 43:
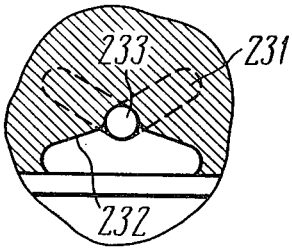
Figure 45:
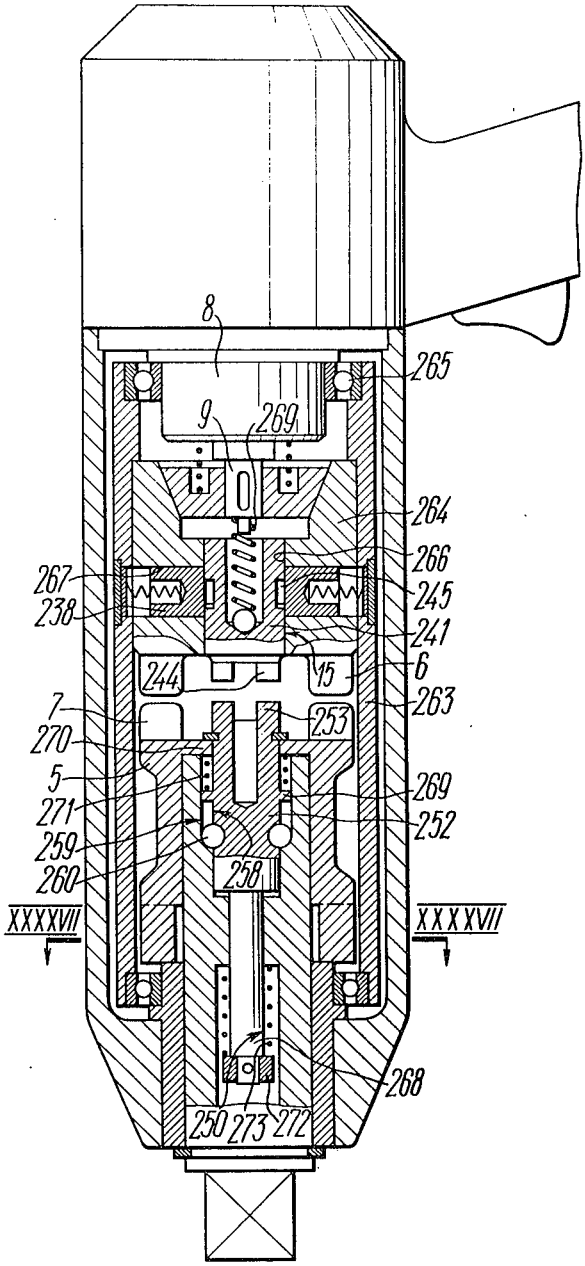
Figure 46:
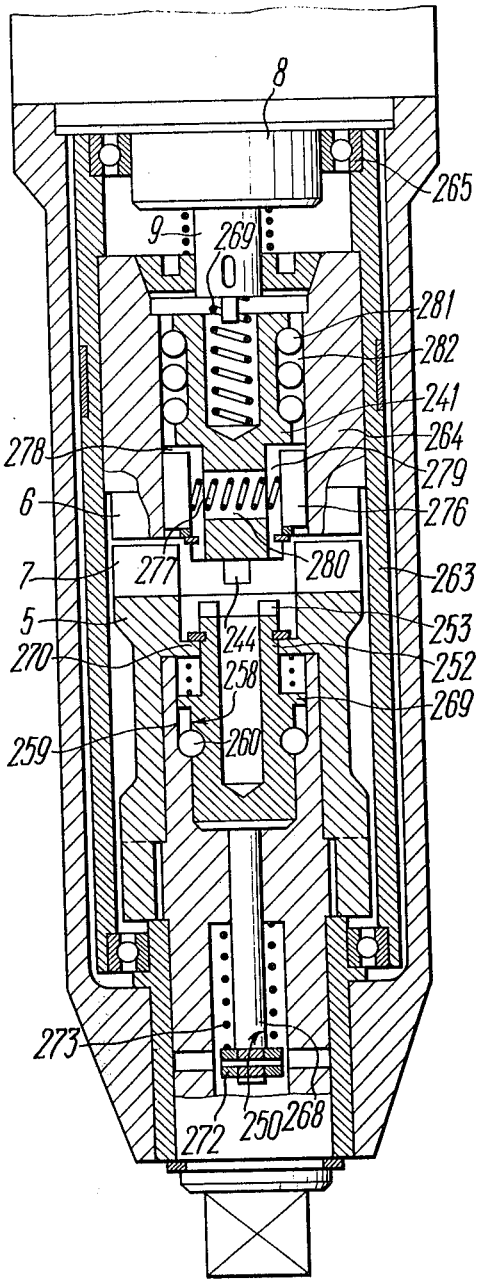
Figure 47:
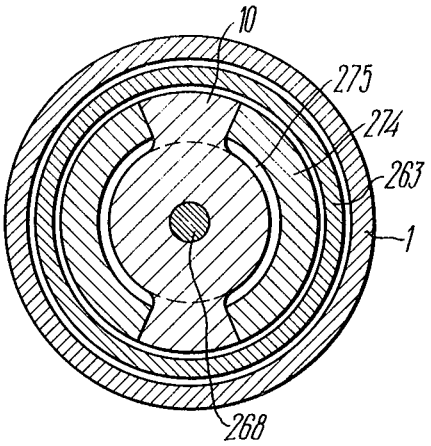
Figure 48:
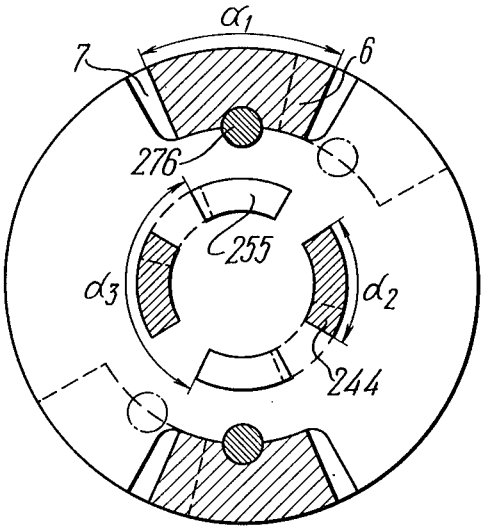

FIG. 28*a* is a partial view of the anvil;

FIG. 28*b* is a view taken along arrow D of FIG. 28*a*;

FIG. 29 is a sectional view taken along line XXIX—XXIX of FIG. 20;

FIG. 30 is a partially cut view of a sixth embodiment of the impact wrench;

FIG. 31 is a sectional view taken along line XXXI—XXXI of FIG. 30;

FIG. 32 is a sectional view taken along line XXXII—XXXII of FIG. 30;

FIG. 33 is a sectional view taken along line XXXIII—XXXIII of FIG. 30;

FIG. 34 is a sectional view taken along line XXXIV—XXXIV of FIG. 30;

FIG. 35 is a partial view of an impact wrench with an electric motor having its rotor embracing the stator;

FIG. 36 is a sectional view taken along line XXXVI—XXXVI of FIG. 35;

FIG. 37 is a sectional view taken along line XXXVII—XXXVII of FIG. 35;

FIG. 38 shows detail E of FIG. 37;

FIG. 39 *a*, *b*, *c* show the shape of the axial projection;

FIG. 40 is a longitudinal section view of a seventh embodiment of the impact wrench;

FIG. 41 is a sectional view taken along line XXXXI—XXXXI of FIG. 40;

FIG. 42 is a sectional view taken along line XXXXII—XXXXII of FIG. 40;

FIG. 43 is a developed view of the device for axial displacement of the driven part of the hammer towards the anvil;

FIG. 44 is a sectional view taken along line XXXXIV—XXXXIV of FIG. 43;

FIG. 45 is a longitudinal section view of an eighth embodiment of the impact wrench;

FIG. 46 is a longitudinal section view of a ninth embodiment of the impact wrench;

FIG. 47 is a sectional view taken along line XXXXVII—XXXXVII of FIG. 45;

FIG. 48 shows schematically the position of the axial projections prior to the engagement of the impact jaws.

An impact wrench comprises a housing 1 (FIG. 1) having a handle 2 with a switch 3 attached to the outer surface of the housing. The housing accommodates: a hammer 4 and an anvil 5 which are mounted coaxially forming a space A therebetween and which are axially movable with respect of each other, the hammer and anvil having impact jaws 6 and 7, respectively; a drive 8 having an output shaft 9 connected to the hammer 4; a spindle 10 having an attachment 11 for receiving a socket wrench, connected to the anvil 5 for rotation together therewith; a device 12 for relative axial displacement of the hammer and anvil for engagement of their impact jaws and for transmitting a torque to the spindle 10; a device 13 for disengaging the impact jaws 6 and 7 of the hammer and anvil.

According to the invention, the impact wrench is provided with a device 14 for preliminary interaction of the hammer 4 and anvil 5 prior to the engagement of their impact jaws 6 and 7 to render the engagement complete over their entire height thereby minimizing wear thereof and improving the impact energy stability.

The device 14 for preliminary interaction of the hammer 4 and anvil 5 comprises two parts 15 and 16 axially movable relative to each other. The first part 15 is disposed in the hammer 4, while the second part 16 is disposed in the anvil 5. The parts 15 and 16 have members engaging each other upon their relative displacement thereby providing for a preliminary interaction of the hammer and anvil. It should be noted that the members of the parts 15 and 16, engaging each other, are located at the same angle to the impact jaws 6 and 7 of the hammer 4 and anvil 5, respectively, whereby the impact jaws 6 and 7 engage each other as they are mutually oriented so as to eliminate incomplete engagement of the impact jaws 6 and 7.

In various embodiments of the impact wrench, the relative displacement of the hammer and anvil for engagement of their impact jaws 6 and 7 is effected either by axial displacement of the hammer 4 towards the anvil 5 or axial displacement of the anvil 5 towards the hammer 4, and, the device 14 for preliminary interaction of the hammer and anvil, as well as the hammer 4 anvil 5 and devices 12 and 13 may be of different structure, accordingly.

I. Impact wrenches in which the hammer is movable relative to the anvil (FIGS. 2 – 43).

The embodiments of the impact wrench shown in FIGS. 2, 6, 11, 16, 20 have a common feature residing in that the hammer 4 is made composite of a driven part 17 and a driving part 18, the driven part 17 being mounted for rotation together with the driving part 18 and for axial displacement towards the anvil 5 so as to increase the moment of inertia of the hammer and to make the wrench more compact.

However, as can be seen from FIGS. 2, 6, 11, 16, 20, the structural embodiment of the driven part 17 and driving part 18 of the hammer may vary to a great extent.

The driven part 17 of the hammer embraces the output shaft 9 of the drive 8 which extends along the entire length of the housing 1, and the geometrical axis of the output shaft 8 coincides with the rotational axis of the hammer 4 and anvil 5.

The free end 19 of the shaft 9 is journalled in an axial bore 20 of the anvil 5.

The output shaft 9 is kinematically associated with the driving part 18 of the hammer by means of a friction clutch 21 urged by a spring 22. This embodiment is used for electrically driven impact wrenches which have device for deenergizing the electric motor prior to the engagement of the impact jaws 6 and 7, that is prior to the transmission of a blow.

In case a pneumatic drive is used or an electric motor having a device for its deenergizing prior to the transmission of a blow, the shaft 9 may be rigidly connected to the shaft of the motor or reduction gear, and the driving part 18 of the hammer can be fixed to the shaft 9 by any appropriate means.

The free end 19 of the shaft 9 (FIGS. 2, 11, 16, 20) is supported on a ball bearing 23 in the axial bore 20 of the anvil.

In these embodiments of the wrench, the first part 15 of the device 14 for preliminary interaction of the hammer and anvil includes the driven part 17 of the hammer.

Figure 2:
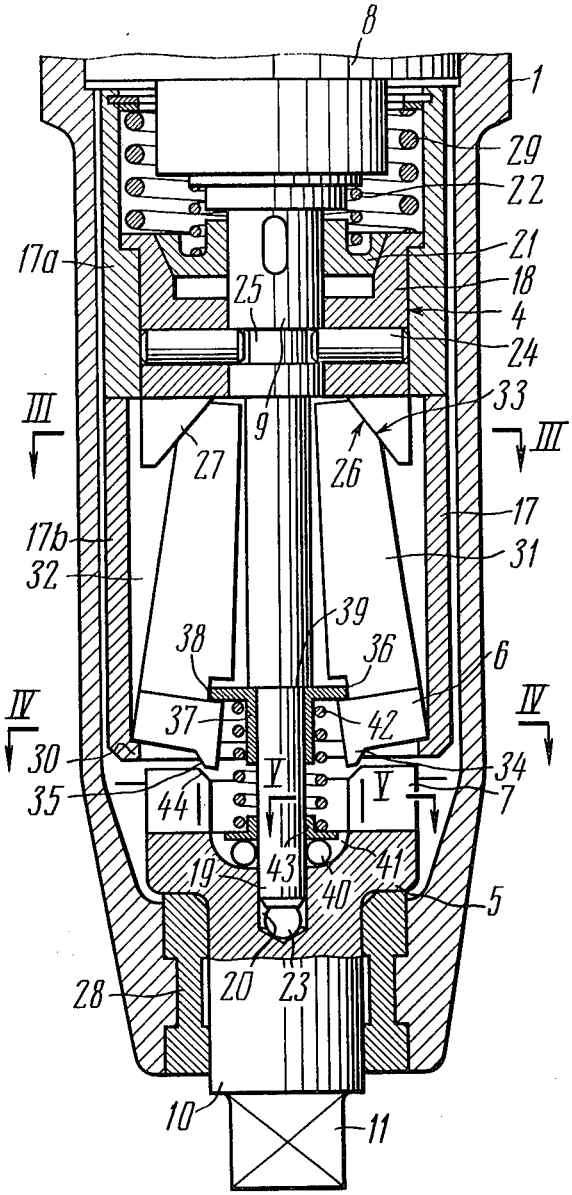
FIG. 2 is a partial longitudinal section view of the impact wrench.

In the impact wrench shown in FIG. 2, the driving part 18 of the hammer is prevented from axial movement along the output shaft 9 by means of pins 24 mounted in radial bores of the driving part 18 and in an annular groove 25 of the shaft 9. The driving part 18 is provided, at the end facing the anvil 5, with a tapered surface 26. It should be noted that the tapered surface 26 may be provided on axial projections 27 of the driving part 18 of the hammer.

The anvil 5 is integral with the spindle 10 which is journalled in a bushing 28 of the housing 1.

The driven part 17 of the hammer is spring-loaded with respect to the driving part 18 by means of a spring 29 and may be made composite consisting of a cylinder 17*a* and a shell 17*b*, the cylinder 17*a* embracing the driving part 18, and the shell 17*b* being rigidly connected with one end thereof to the cylinder 17*a*. The free end of the shell 17*b* is provided with radially inwardly directed projections 30 facing the shaft 9.

The first part 15 of the device for mary interaction of the hammer and anvil includes the driven part 17 of the hammer and flyweights 31.

Figure 3:
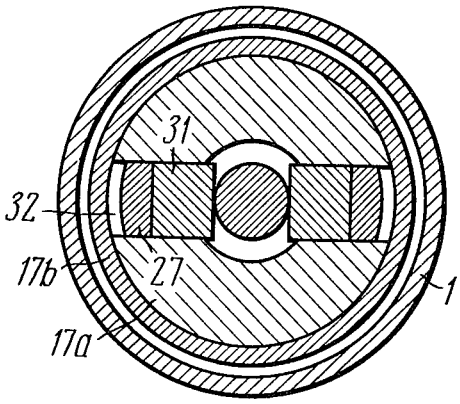
FIG. 3 is a sectional view taken along line III—III of FIG. 2.
Figure 4:
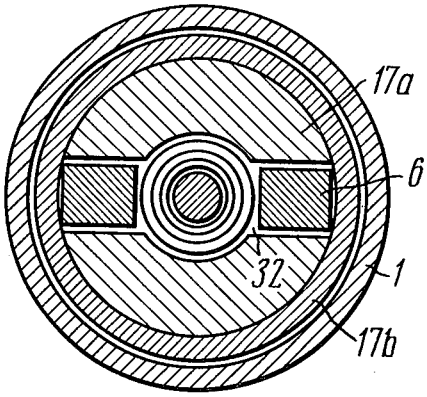
FIG. 4 is a sectional view taken along line IV—IV of FIG. 2.
Figure 5:
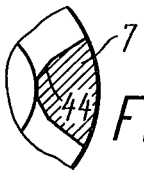
FIG. 5 is a sectional view taken along the line V—V of FIG. 2.

The flyweights 31 comprise flat elongate members of rectangular cross-section (FIGS. 3 and 4).

The shell 17*a* has longitudinally extending recesses 32 of rectangular cross-section accommodating the flyweights 31 and receiving the projections 27 of the driving part 18 of the hammer (FIG. 2).

The flyweights 31 are mounted in the recesses 32 in an inclined position, and one end of each flyweight bears against the projection 30 of the shell 17*b*, while the other end bears against the tapered surface 26 of the projection 27, tapered surfaces 33 being provided at the ends of the flyweights 31 remote from the anvil 5 to cooperate with the tapered surfaces 26.

At the end of each flyweight 31 facing the anvil 5 and bearing against the projections 30 there are arranged the impact jaws 6 of the hammer.

The impact jaws 6 are provided with projections 34 having tapered surfaces 35, the projections 34 being located adjacent to the shaft 9.

Notches 36 are made in the flyweights 31 at the side thereof facing the shaft 9.

The flyweights 31 are retained in engagement with the projections 30 of the driven part 17 of the hammer by means of a bush 37. The bush 37 is mounted on the shaft 9 and has a flange 38 received in the notches 36 of the flyweights 31. One end of the bush 37 bears against a shoulder 39 of the shaft 9, and the other end is supported by means of a bearing 40 disposed in a counterbore 41 of the axial bore 20 of the anvil 5.

The bush 37 is urged away from the anvil 5 by means of a spring 42 disposed between the flange 38 thereof and a flange 43 of the bearing 40.

The second part 16 of the device 14 for preliminary interaction of the hammer and anvil comprises a cam surface 44 (FIG. 5) disposed on the inner side (i.e. on the side facing the output shaft 9) of the impact jaws 7 of the anvil 5. The tapered surface 35 of the projection 34 and the cam surface 44 constitute the members engaging each other upon the displacement of the driven part 17 of the hammer towards the anvil 5. Since these members are located directly on the impact jaws of the hammer and anvil, there is no need to position them at a predetermined angle to the impact jaws 6 and 7.

The flyweights 31 form the device 12 for displacement of the driven part 17 of the hammer towards the anvil for engagement of their impact jaws 6 and 7. During the rotation of the driving and driven parts of the hammer until the achievement of a predetermined rotational speed of the hammer, these flyweights 31 change their position under the action of centrifugal forces to displace the driven part 17 of the hammer towards the anvil.

The device 13 for disengaging the impact jaws comprises springs 29 and 42 which are compressed during the displacement of the driven part 17 of the hammer towards the anvil 5 so as to return the driven part 17 of the hammer into the initial position after the transmission of a blow, the engagement of the flyweights 31 with the projections 30 being ensured by the tapered surface 26 which provides for the inclined position of the flyweights 31 as shwon in FIG. 2.

The above-described impact wrench operates as follows.

In the initial position, there is a gap between the impact jaws 6 and 7 of the hammer 4 and anvil 5, respectively, the flyweights 31 have their impact jaws 6 bearing against the projections 30 of the driven part 17, the bush 37 bears against the shoulder 39 and the flange thereof is engaged with the notches 36. After the drive 8 has been energized, the driving part 18 and driven part 17 of the hammer rotating together at a predetermined speed, the ends of the flyweights 31 remote from the anvil 5 start moving away from the center (i.e. away from the shaft 9) towards the periphery under the action of centrifugal forces. Thus, as a result of cooperation of the tapered surfaces 26 of the projections 27 with the tapered surfaces 33 of the flyweights 31, the latter will move axially towards the anvil 5 together with the driven part 17 of the hammer because they are connected thereto by means of the projection 30. The bush 37 will move in the same direction due to the cooperation of the flange 38 thereof with the notches 36 to compress the springs 29 and 42. The relative displacement of the flyweights 31, driven part 17 of the hammer and the bush 37 will occur until the projections 34 of the impact jaws 6 approach the area in which the impact jaws 7 of the anvil 5 are located.

During further displacement and rotation of the driven part 17 of the hammer and flyweights 31, the tapered surfaces 35 of the projections 34 engage the cam surfaces 44 of the impact jaws 7 to displace the flyweights 31 away from the periphery towards the center and to disengage the flyweights 31 from the projections 30, hence, to disengage the bush 37 from the driven part 17 of the hammer.

After the disengagement, the flyweights 31 will move, together with the bush 37, towards the anvil 5 for engagement of the impact jaws 6 of the hammer 4 with the impact jaws 7 of the anvil 5. Upon the engagement of the impact jaws 6 and 7 a blow is delivered wherewith the kinetic energy accumulated in the rotating mass of the hammer and flyweights 31 is transmitted to a threaded fastener (not shown) through the spindle 10. Then the springs 29 and 42 return the parts of the mechanism to the initial position, and the blows are repeated at regular intervals until the drive is deenergized, the impact wrench operating in the above sequence. The bush 37 ensures the concurrent engagement of the impact jaws 6 of both flyweights 31 with the impact jaws of the anvil since in the case of disengagement of only one flyweight 31 from the driven part 17 of the hammer, this flyweight will not be able to move towards the anvil jaws 7 due to the fact that the other flyweight 31 is engaged with the driven part 17 of the hammer and both flyweights 31 are interconnected by means of the flange 38 of the bush 37.

Since the projections 34 with the tapered surfaces 35 are provided on the impact jaws 6 of the hammer 4 and the cam surfaces 44 are made on the impact jaws 7 of the anvil 5, the displacement of the flyweights 31 towards the anvil 5 occurs the impact jaws 6 and 7 being in a predetermined relative angular position to ensure their complete engagement.

In the embodiments of the impact wrench shown in FIGS. 6, 11, 16, 20, there is provided a mechanism for axial displacement of the first part 15 of the device 14 towards the second part 16 thereof. This mechanism is disposed between the driving part 18 of the hammer and the first part 15 of the device 14.

Figure 6:
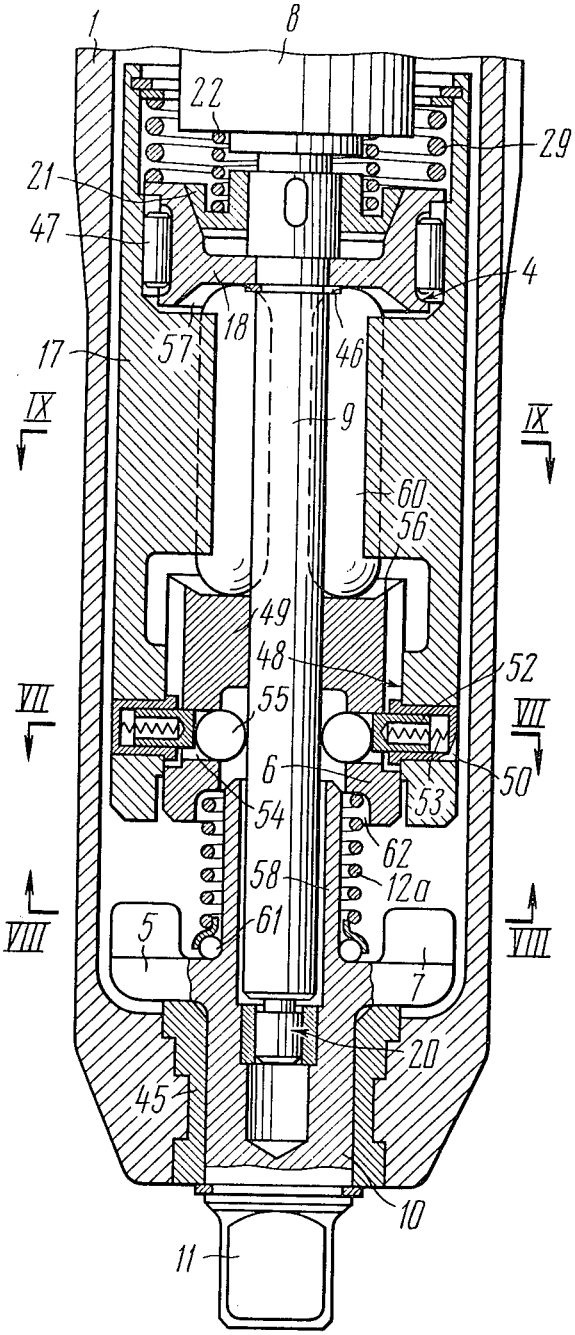
FIG. 6 is a partially cut view of another embodiment of the impact wrench.

In the impact wrench shown in FIG. 6 the anvil 5 is integral with the spindle 10 which is journalled in a bushing 45 of the housing 1.

The driving part 18 of the hammer is fixed to the shaft 9 of the drive 8 by means of a retaining ring 46 and connected to the driven part 17 by means of keys 47 for combined rotation of the parts 17 and 18 and for axial displacement of the driven part 17 relative to the driving part 18.

Figure 7:
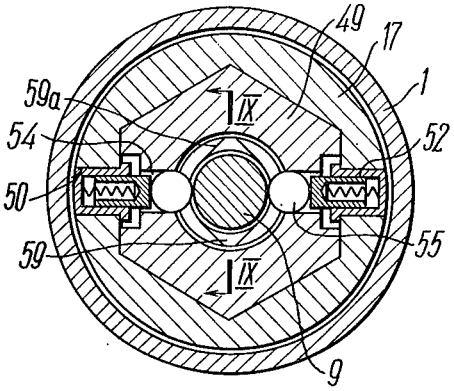
FIG. 7 is a sectional view taken along line VII—VII of FIG. 6.
Figure 8:
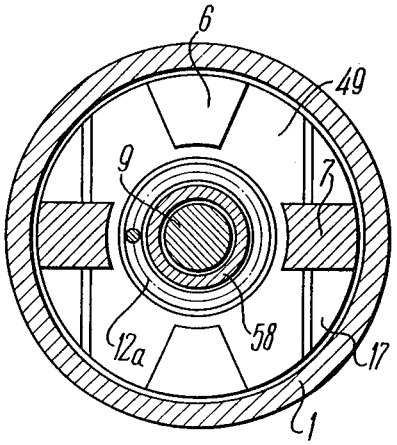
FIG. 8 is a sectional view taken along line VIII—VIII of FIG. 6.

In this embodiment, the first part 15 of the device 14 includes the driven part 17 of the hammer which has an axial bore 48, as well as a sleeve 49 mounted in the bore 48 for rotation together with the driven part 17 and for axial displacement relative thereto. For that purpose, the bore 48 and the sleeve 49 are of hexagonal section as shown in FIG. 7.

The end of the sleeve 49 (FIG. 8) facing the anvil is provided with the impact jaws 6.

Figure 9:
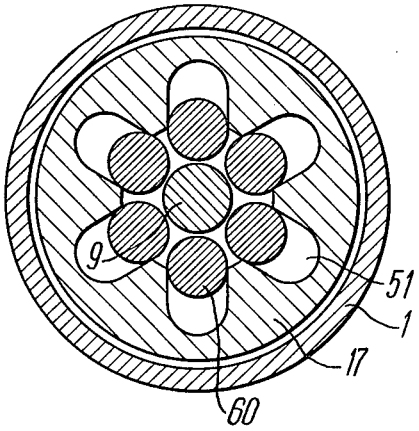
FIG. 9 is a sectional view taken along line IX—IX of FIG. 7.
Figure 10:
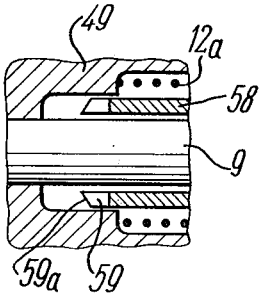
FIG. 10 is a sectional view taken along line X—X of FIG. 6.

The driven part 17 of the hammer (FIG. 6) has radial bores 50 and longitudinally extending recesses 51 (FIG. 9) surrounding the shaft 9 as shown in FIG. 9.

The radial bores 50 (FIG. 6) accommodate spring-loaded locking members 52. Each locking member comprises two bushes inserted into each other, the outer bush being fixed in the bore 50, and the inner bush being axially movable in the outer bush. A spring 53 disposed between the bushes returns the inner bush to the initial position.

The sleeve 49 is provided with radial bores 54 opposite to the bores 50 for receiving pushers 55 comprising balls. It should be noted that the locking members 52 partially project into the radial bores 54 of the sleeve 49 so as to retain the sleeve 49 within the bore 48 of the driven part 17 of the hammer to prevent it from axial movement till a predetermined moment.

Tapered surfaces 56 and 57 are provided at the ends of the sleeve 49 and the driving part 18 of the hammer facing each other.

The second part 16 of the device 14 for preliminary interaction of the hammer and anvil comprises a tubular member 58 embracing the shaft 9. The tubular member 58 is integral with the anvil 5 and has axial projections 59 (FIGS. 7 and 10) at the free end thereof, which are axially arranged between the impact jaws 7 of the anvil and the impact jaws 6 of the hammer (FIG. 6), the axial projections engaging with their tapered surfaces 59*a* (FIG. 7) the pushers 55 upon the axial displacement of the driven part 17 of the hammer towards the anvil 5 for actuating the locking members 52 and for disengagement of the sleeve 49 from the driven part 17 of the hammer.

The mechanism for displacement of the first part 15 of the device 14 towards the second part 16 thereof comprises cylindrical flyweights in the form of rods 60 extending in parallel with the shaft 9 within the longitudinally extending recesses 51 of the driven part 17 of the hammer (FIG. 9). The cylindrical rods 60 (FIG. 6) have their ends bearing against the tapered surfaces 57 and 56 of the driving part 18 of the hammer and bush 49, respectively, and at the same time, they form the device 12 for displacement of the driven part 17 of the hammer towards the anvil 5.

It should be noted that the axial projections 59 (FIG. 7) and the pushers 55 constitute the members engaging each other upon the displacement of the driven part 17 of the hammer towards the anvil and are at the same angle to the impact jaws 7 and 6, of the anvil 5 and hammer, respectively.

The device 13 (FIG. 6) for disengaging the impact jaws 6 and 7 is disposed between the sleeve 49 and anvil 5 and comprises a return spring 12*a* embracing the tubular member 58 and abutting with ont end against a thrust bearing 61 disposed in the anvil, the other end of the spring being received in a counterbore 62 of the end wall of the sleeve 49 facing the anvil 5.

The above-described impact wrench operates as follows.

After the drive has been energized the driving part 18 and the driven part 17 of the hammer, as well as the sleeve 49 start rotating together. When the hammer gains a predetermined rotational speed, the cylindrical rods 60 start moving under the action of centrifugal forces along the tapered surfaces 57 and 56 away from the shaft 9 towards the periphery. During this movement of the cylindrical rods 60, the driven part of the hammer, and the sleeve 49 which is connected thereto by means of the locking members 52, move towards the anvil 5 to compress the springs 29 and 12*a*. The combined movement of the driven part 17 and sleeve 49 will continue until the pushers 55 approach the axial projections 59 of the tubular member 58. Subsequently, the axial projections 59 will cooperate with the pushers 55 at the tapered surfaces 59a so that the pushers are forced into the radial bores 54 of the sleeve 49 to act on the locking members 52 to force them into the racial bores 50 of the driven part 17 of the hammer. Thus, the springs 53 are compressed, and the sleeve 49 is disengaged from the driven part 17 of the hammer to move towards the anvil 5 under the action of the cylindrical rods 60 engagement of the impact jaws 6 of the sleeve with the impact jaws 7 of the anvil 5. Upon the engagement of the impact jaws 6 and 7, a blow is imparted to transmit the kinetic energy accumulated in the rotating masses of the driven and driving part 17 and 18 of the hammer into a threaded fastener. After the braking of the rotating parts as a result of the blow transmission, the cylindrical rods 60 return to the initial position, the spring 12a returns the sleeve 49 to the initial position in which it is retained by means of the locking members 52 expelled from the radial bores 50 by the springs 53, and the spring 29 returns the driven part 17 of the hammer to the initial position.

Then the blows are repeated at regular intervals as described above until the drive 8 is deenergized.

Since the pushers 55 and the axial projections 59 are at the same angle to the impact jaws 6 and 7, respectively, the displacement of the sleeve 49 towards the anvil 5 occurs at a predetermined relative angular position of the impact jaws, whereby the impact jaws 6 and 7 are completely engaged.

Figure 11:
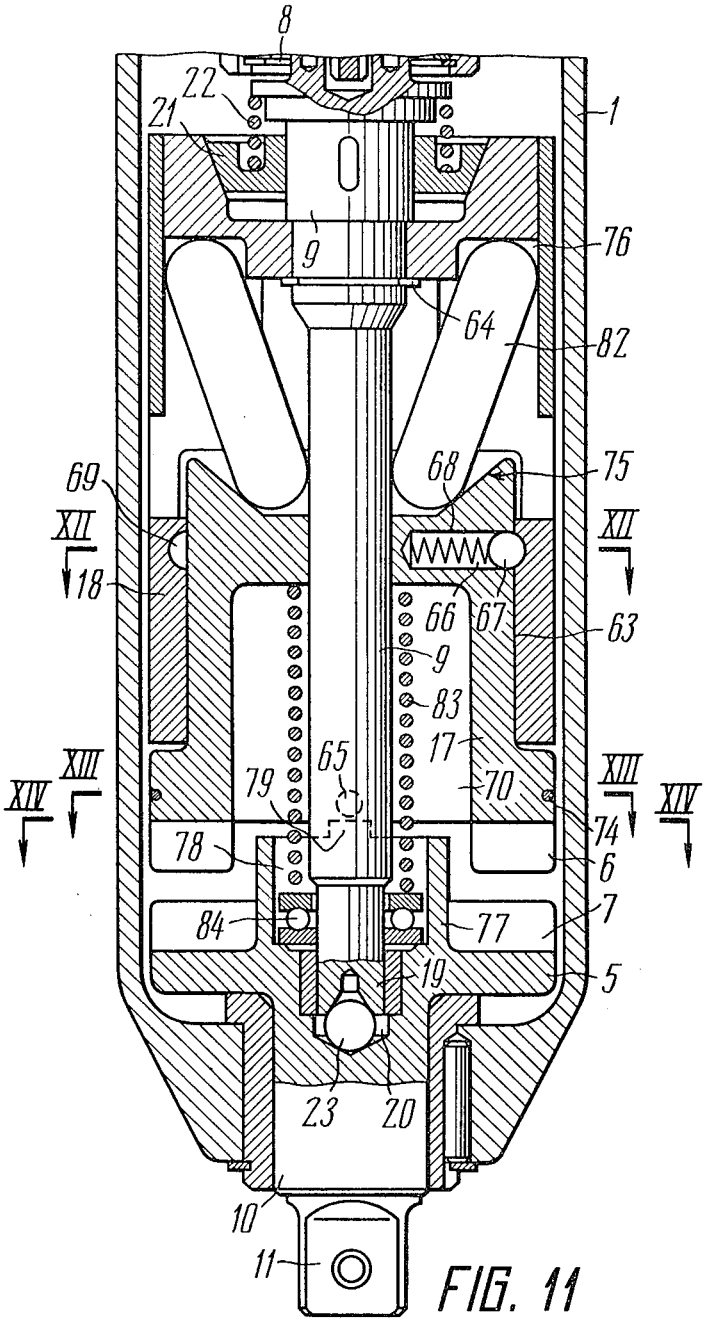
FIG. 11 is a partially cut view of still another embodiment of the impact wrench.
Figure 12:
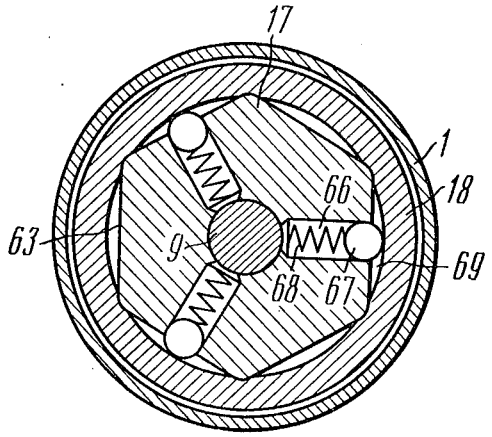
FIG. 12 is a sectional view taken along line XII—XII of FIG. 11.
Figure 14:
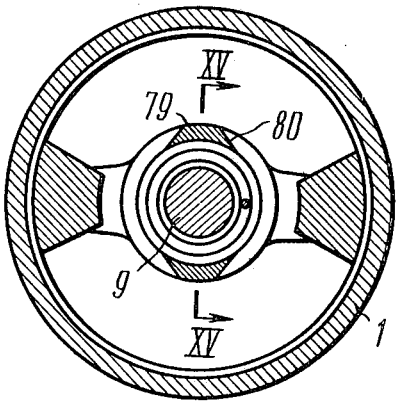
FIG. 14 is a sectional view taken along line XIV—XIV of FIG. 11.
Figure 13:
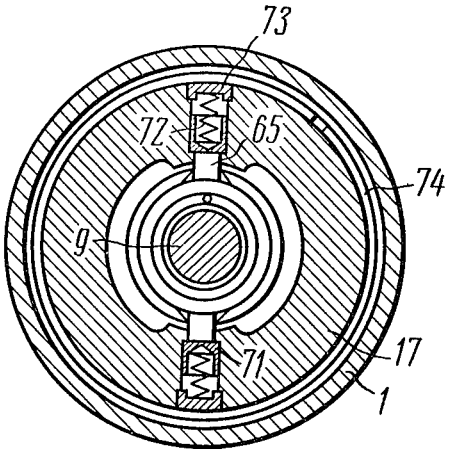
FIG. 13 is a sectional view taken along line XIII—XIII of FIG. 11.

In the impact wrench shown in FIG. 11, the anvil 5 is integral with the spindle 10.

The driving part 18 and driven part 17 of the hammer are interconnected at a hexagonal guide surface 63 (FIG. 12) for their combined rotation with the possibility of axial displacement of the driven part 17 (FIG. 11) relative to the driving part 18 which is fixed to the shaft 9 by means of a retaining ring 64.

The first part 15 of the device 14 for preliminary interaction of the hammer and anvil includes the driven part 17 of the hammer and spring-loaded locking members 65.

The driven part 17 of the hammer has radial bores 66 (FIG. 12) accommodating springs 67 urged by springs 68 in such a manner that the balls project from the bores 66. An annular groove 69 is provided in the driving part 18 of the hammer opposite to the radial bores 66, the balls 67 being partially received in the annular groove 69.

An axial bore 70 is provided in the driven part 17 of the hammer (FIG. 11), and the impact jaws 6 are provided at the end thereof facing the anvil 5, the body of the driven part 17 of the hammer adjacent to this end being provided with radial bores 71 (FIG. 13) accommodating spring-loaded locking members 65 urged by springs 72.

The springs 72 are retained by means of screw taps 73 fixed by means of a ring 74 embracing the driven part 17 of the hammer. The locking members 65 project under the action of the springs 72 from the driven part of the hammer into the axial bore 70 thereof.

The end of the driven part 17 of the hammer remote from the anvil 5 (FIG. 11) is provided with a tapered surface 75, and the driving part 18 of the hammer has recesses 76 which are located at a greater distance from the shaft 9 than the tapered surface 75.

The second part 16 of the device 14 for preliminary interaction of the hammer and anvil comprises an annular projection 77 disposed on the anvil 5 and embracing the output shaft 9 in such a manner that a space 78 is provided between the shaft 9 and the annular projection 77.

Figure 15:
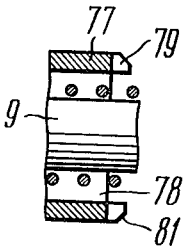
FIG. 15 is a sectional view taken along XV—XV of FIG. 14.

At the end of the annular projection 77 facing the driven part 17 of the hammer, there are provided axial cams 79 having tapered surfaces 80 (FIG. 14) and 81 (FIG. 15). The axial cams 79 (FIG. 11) are axially disposed between the impact jaws 7 of the anvil and locking members 65.

In this embodiment, the mechanism for displacement of the first part 15 of the device 14 towards the second part thereof, as well as the device 12 for axial displacement of the driven part 17 of the hammer towards the anvil 5 comprise cylindrical rods 82 each having one end disposed in the recess 76 and the other end bearing against the surface 75, the cylindrical rods 82 being mounted at an angle to the output shaft 9.

The device 13 for disengaging the impact jaws 6 and comprises a spring 83 embracing the output shaft 9 and disposed in the axial bore 70 and within the space 78. One end of the spring 83 bears against the driven part 17 of the hammer, and the other end is supported by a thrust bearing 84 mounted in the space 78.

The spring-loaded locking members 65 and the axial cams 79 constitute the members of the parts 15 and 16, respectively, of the device 14 engaging each other upon the displacement of the driven part 17 of the hammer towards the anvil 5, that is upon the displacement of the first part 15 towards the second part 16.

The above-described impact wrench operates as follows.

After the drive has been energized, the driving part 18 and driven part 17 of the hammer start rotating together. After the hammer gains a predetermined rotational speed, the cylindrical rods 82 starts rocking about the support point at the ends of the recesses 76 under the action of centrifugal forces to act on the tapered surface 75, whereby the driven part 17 of the hammer is displaced towards the anvil 5 along the hexagonal surface 63 of the driving part 10.

Thus, the balls 67 are expelled from the annular groove 69 to compress the springs 68.

During further displacement of the driven part 17 of the hammer, the locking members 65 engage either the end face of the annular projection 77 or the tapered surface 81 of the axial cams 79. If the first engagement of the locking members 65 occurs with the end face of the annular projection 77, further displacement of the driven part 77 towards the anvil will take place only after the locking members 65 will have been received in the bores 71 under the action of the tapered surfaces 80 (FIG. 14) of the cams 79.

Should the first engagement of the locking members 65 occur with the tapered surfaces 81 (FIG. 15) of the cams 79, the locking members 65 are first retracted (FIG. 11), then further displacement of the driven part 17 of the hammer towards the anvil 5 will become possible to compress the spring 83. Therefore, in any case, the displacement of the driven part 17 of the hammer at a distance providing for a desired engagement of the impact jaws 6 and 7 takes place at a predetermined relative angular position of the latter which is due to a predetermined relative angular position of the jaws 6 and locking members 65, as well as of the jaws 7 and axial cams 79. This relative angular positioning provides for complete engagement of the impact jaws 6 and 7. When the rotating hammer engages with its impact jaws 6 the impact jaws 7 of the stationary anvil 5, a blow is delivered and the kinetic energy of the accelerated masses of the hammer is transmitted to the a threaded fastener.

After the transmission of a blow, the driven part 17 of the hammer is returned by the spring 83 to the initial positions, the cylindrical rods 82 are also returned to the initial position, and the locking members 65 and the balls 67 are returned to the initial position under the action of the springs 72 and 68, respectively. Then the blows are repeated at regular intervals, and all mechanisms of the wrench operate in the above-described sequence.

Figure 16:
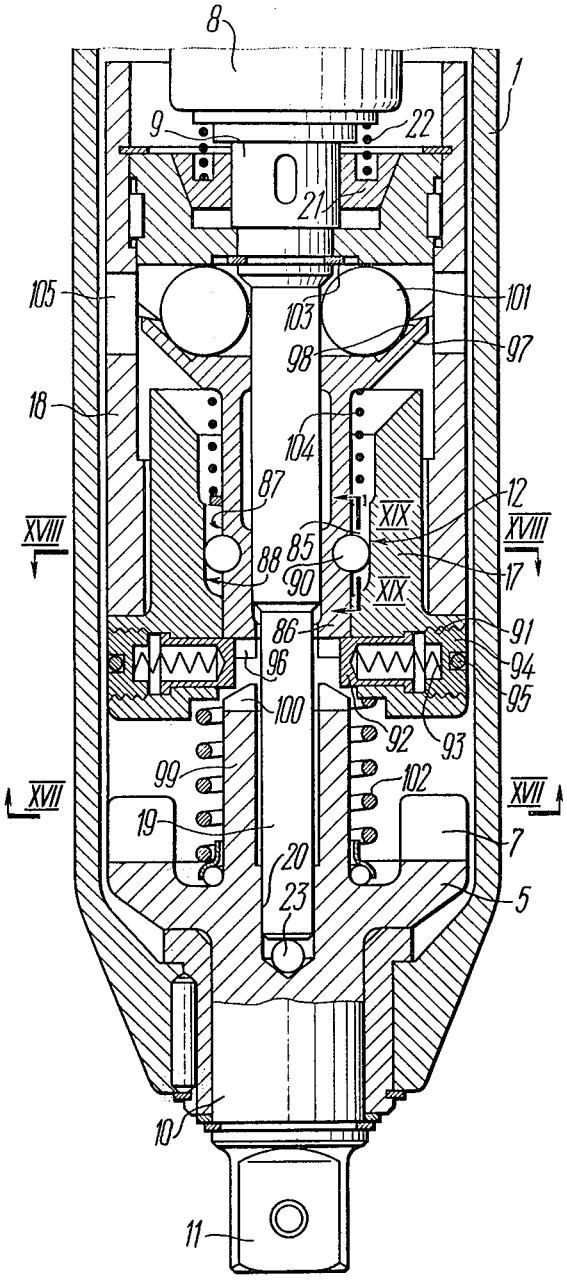
FIG. 16 is a partial longitudinal section view of a fourth embodiment of the impact wrench.
Figure 17:
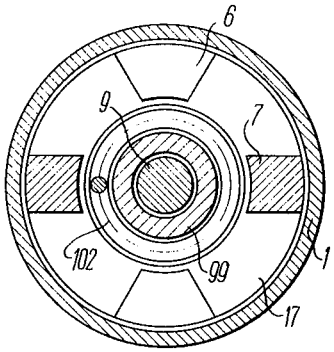
FIG. 17 is a sectional view taken along line XVII—XVII of FIG. 16.

In the embodiments of the impact wrench shown in FIGS. 16 and 20, the anvil 5 is integral with the spindle 10.

The first part 15 of the device 14 for preliminary interaction of the hammer and anvil includes the driven part 17 of the hammer having impact jaws 6 and an axial bore 85, as well as tubular member 86 embracing the output shaft 9 of the drive 8.

The device 12 for axial displacement of the driven part of the hammer towards the anvil for engagement of their impact jaws 6 and 7 (FIG. 17) is disposed between the tubular member 86 and the driven part 17 of the hammer. This device 12 (FIGS. 16, 20) comprises V-shaped grooves 87 (FIG. 19) on the periphery of the tubular member 86, V-shaped recesses 88 on the inner surface 89 of the driven part 17 of the hammer and balls 90 received in the V-shaped grooves 87 and recesses 88.

It should be noted that the vertices of the V-shaped grooves 87 and recesses 88 are located at one and the same angle with respect to the impact jaws 6 of the hammer as the members of the first part 15 of the device 14.

The device 12 constitutes, at the same time, the device for connecting the driven part 17 of the hammer to the tubular member 86 for their combined rotation.

The driven part 17 of the hammer shown in FIG. 16 has radial bores 91 accommodating spring-loaded locking members 92 which project from the driven part 17 under the action of springs 93 into an axial bore 85. The locking members 92 are retained in the bores 91 by means of screw taps 94 and an expansion ring 95 embracing the driven part 17 of the hammer. The tubular member 86 is supported at the end face thereof by the ends of the locking members 92 projecting from the driven part 17 of the hammer so that the tubular member 86 is prevented from displacing towards the second part 16 of the device 14.

The end of the tubular member 86 facing the anvil 5 is provided with axial projections 96, and the other end thereof has a flange 97 with a tapered surface 98.

The second part 16 of the device 14 for preliminary interaction of the hammer and anvil comprises an annular projection which is integral with the anvil 5, embraces the output shaft 9 and has axial cams 100.

The cams 100 are axially disposed between the impact jaws 7 of the anvil 5 and the locking members 92.

The mechanism for displacement of the first part 15 of the device 14 towards the second part 16 thereof comprises balls disposed between the driving part 18 of the hammer and the tapered surface 98 of the tubular member 86.

The device 13 for disengaging the impact jaws 6 and 7 comprises a return spring 102 embracing the output shaft 9 and the annular projection 99, the spring being disposed between the anvil 5 and the driven part 17 of the hammer.

The axial projections 96, locking members 92 and the axial cams 100 of the annular projection 99 constitute the members of the parts 15 and 16 of the device 14 engaging each other upon the displacement of the driven part 17 of the hammer towards the anvil 5.

The driving part 18 of the hammer either may be made in the form of a single part, or it may consist of several pieces rigidly connected to one an other, and the driving part 18 is fixed to the shaft 9 by means of an expansion ring 103.

Figure 18:
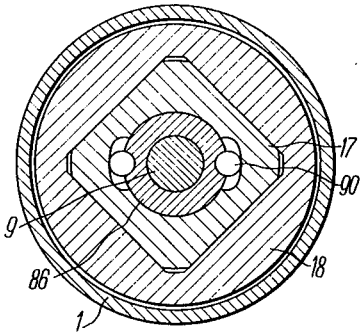
FIG. 18 is a sectional view taken along line XVIII—XVIII of FIG. 16.

The driven part 17 of the hammer is mounted within the driving part 18, and their mating surfaces define a square cross-section as shown in FIG. 18.

A spring 104 is mounted between the flange 97 of the tubular member 86 and the driven part 17 of the hammer.

A hole 105 is provided in the driven part 17 of the hammer opposite to the balls 101.

The above-described impact wrench operates as follows.

After the drive have been energized and the driving part 18, driven and tubular member 86 part of the hammer 17 gained a predetermined rotational speed, the balls 101 start moving away from the output shaft 9 towards the periphery under the action of centrifugal forces to act on the tapered surfaces 98 of the tubular member 86. Thus, the tubular member 86 starts moving towards the anvil 5, and, due to the fact that the end of the tubular member bears against the projecting ends of the locking members 92, the tubular member 86 displaces the driven part 17 of the hammer towards the anvil 5. The springs 104 and 102 are compressed, and the balls 90 run into the coinciding vertices portions 106 (FIG. 19) of the V-shaped grooves 87 and recesses 88. During further movement of the tubular member 86 together with the driven part 17 of the hammer, the locking members 92 are displaced into the area located wherein are the axial cams 100 which force the locking members 92 into the radial bores 91 to compress the springs 93 and to disengage the locking members from the end face of the tubular member 86. Thus, the tubular member 86 is displaced towards the anvil 5 under the action of the balls 101, and its axial projections 96 engage the axial cams 100, the balls 101 leaving the tapered surface 98 and moving over the end face of the flange 97 to be partially received in the holes 105 of the driving part 18 of the hammer during the displacement of the tubular member 86.

Incomplete engagement of the axial projections 96 and cams 100 is eliminated due to the location of the locking members 92 opposite to the projections 96.

After the engagement of the projections 96 of the rotating tubular member 86 with the cams 100 of the stationary annular projection 99 of the anvil 5, the tubular member 86 is stopped, and the driven part 17 of the hammer, which continues to rotate, is displaced towards the anvil 5 for engagement of the impact jaws 6 and 7 due to the fact that the balls 90 run in the V-shaped grooves 87 and recesses 88. Upon the engagement of the impact jaws 6 and 7, a blow is delivered and the kinetic energy of the accelerated masses of the hammer and balls 101 is transmitted to the threaded fastener being tightened.

Since the driving part 18 and the driven part 17 of the hammer are completely braked at the instant of the blow, the springs 102 and 104 return the driven part 17 of the hammer and the tubular member 86, respectively, to the initial position, and the blows are repeated at regular intervals in the above-described sequence.

As distinct from the impact wrench described with reference to FIG. 16, in the impact wrench shown in FIG. 20, the mechanism for displacement of the first part 15 of the device 14 towards the second part thereof is disposed between the driving part 18 and the driven part 17 of the hammer. To this end, the driving part 18 of the hammer has radial holes 107 of a diameter corresponding to that of the balls 101. The holes 107 receive the balls 101 of the mechanism and projections 108 of the driven part 17 of the hammer which having tapered surfaces 109 at the sides thereof facing the balls 101. During the displacement of the balls 101, the latter act on the tapered surfaces 109 thus causing the displacement of the driven part 17 of the hammer towards the anvil 5. It should be noted that the driving part 18 and the driven part 17 of the hammer are interconnected for combined rotation and for axial displacement of the driven part 17 relative to the driving part by means of slots 110 (FIG. 21) of the driven part 17 of the hammer and splines 111 of the driving part of the hammer which are received in the slots 110. The displacement of the balls 101 (FIG. 20) in the holes 107 is limited by means of an expansion ring 112.

The tubular member 86 is fixed on the shaft 9 against axial movement by means of expansion rings 113 and 114 and has a shoulder 115 received in the axial bore 85 of the driven part 17 of the hammer which also has a shoulder 116. A spring 117 is disposed in the bore 85 between the shoulders 115 and 116.

Figure 22:
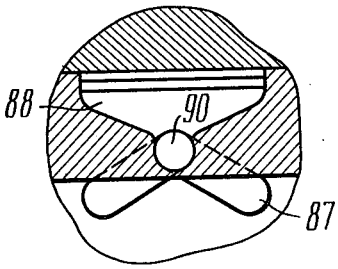
FIG. 22 is a developed sectional view taken along line XXII—XXII of FIG. 20.
Figure 23:
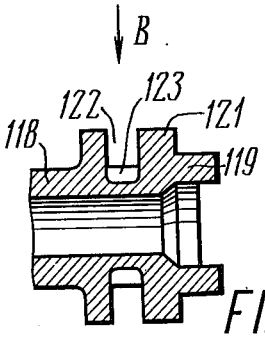
FIG. 23 is a partial view of the bush.

The device 12 for axial displacement of the driven part 17 of the hammer is similar to that used in the impact wrench described with reference to FIG. 16 and comprises V-shaped grooves 87, V-shaped recesses 88 and balls 90; this device is shown in a developed view in FIG. 22.

Figure 24:
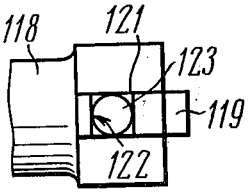
FIG. 24 is a view taken along arrow B of FIG. 23.

The second part 16 of the device 14 for preliminary interaction of the hammer and anvil comprises an axially movable bush 118 having axial cams 119. The bush 118 is mounted in an axial bore of the anvil 5 and permanently urged towards the hammer by means of a spring 120. The bush 118 has an enlarged portion 121 with the axial cams 119 and a slot 122 (FIG. 23) terminating in a recess 123 (FIG. 24). The slot 122 accommodates a locking member 125 urged by springs 124 (FIG. 20). The locking members 125 have shoulders 126 (FIG. 25) with flats 127 (FIG. 126) cooperating with an annular projection 128 (FIGS. 27, 28 *a, b*) of the anvil 5. The annular projection 128 has openings 128*a* for receiving the enlarged portion 121 of the bush 118 so that the spindle 10 and the bush 118 may rotate together, and the bush is axially movable relative to the spindle.

The impact jaws 6 (FIG. 20) of the driven part 17 of the hammer are provided at the inner side (i.e. adjacent to the shaft 9) with a tapered portion 129 having its surface cooperating with the locking members 125 during the displacement of the driven part 17 of the hammer towards the anvil 5.

The axial projection 96 and the axial cams 119 constitute the members of the parts 15 and 16 of the device 14 engaging each other.

The above-described impact wrench opeates as follows.

After the drive has been energizing, the driving part 18 of the hammer starts rotating together with the driven part 17 thereof and the tubular member 86. At a predetermined rotational speed the balls 101 are displaced in the holes 107 under the action of centrifugal forces away from the shaft 9 towards the periphery to act on the tapered surfaces 109 of the projections 108 of the driven part 17 of the hammer and to displace the driven part towards the anvil. The balls 90 (FIG. 22) leave the vertex portions along the recesses 88, and the tapered portions 129 of the impact jaws 6 cooperate with the locking members 125 (FIG. 23, 24) to force the latter into the recesses 123 of the slots 122. The shoulders 126 (FIGS. 25, 26) of the locking members 125 slide from the annular projection 128 (FIGS. 27, 28) of the anvil, and the bush 118 (FIG. 20) is displaced under the action of the spring 120 towards the tubular member 86 for engagement of the axial cams 119 of the bush with the axial projections 96 of the tubular member, incomplete engagement of the cams and projections being eliminated due to the location of the cams 119 and projections 96 at the same angle to the impact jaws 6 and 7.

After the engagement of the rotating tubular member 86 with the stationary bush 118, the tubular member is stopped, and the driven part 17 of the hammer continues its displacement towards the anvil 5 due to the displacement of the balls 90 in the grooves 87 and recesses 88 during the rotation of the driven part 17 of the hammer. During this displacement, the impact jaws 6 of the driven part 17 of the hammer engage the impact jaws 7 of the anvil 5 over their entire height, and a blow is delivered with the kinetic energy of the accelerated masses of the hammer and balls 101 being transmitted to a threaded fastener to be tightened.

During the displacement of the driven part 17 towards the anvil after the engagement of the bush 118 and the tubular member 86, the latter acts on the bush 118 to return it to the initial position. The locking members 125 are returned to the initial position under the action of the springs 124, and the shoulders 126 of the locking members 92 lock the bush 118 against the annular projection 128 of the anvil (FIG. 28).

Since at the instant of blow transmission the driving part 18 of the hammer and the driven part 17 thereof are completely braked, the spring 117 causes the rotation of the tubular member 86, and the driven part 17 of the hammer is returned to the initial position during the rotation of the member 86 due to the fact that the balls 90 are again displaced into the vertices of the V-shaped grooves. During the displacement of the driven part 17 of the hammer into the initial position, the projections 108 thereof cause the displacement of the balls 101 to the initial position, and the blows are repeated at regular intervals in the above-described sequence until the drive is deenergized.

In the impact wrench shown in FIG. 30, the hammer 4 consists of a driving part 130 and a driven part 131.

The driving part comprises a hollow cylindrical body embracing the anvil 5 and is journalled in bearings 132 and 133 fixed in the housing 1.

The driving part 130 of the hammer engages, via an intermediate piece 134 and keys 135, a spring-loaded friction clutch 136 mounted on an output shaft 137. The driven part 131 has impact jaws 6, is disposed within the driving part 130 and connected thereto along flat surfaces 138 defining a square cross-section as shown in FIG. 31 so as to provide for combined rotation of these parts and axial displacement of the driven part 131 towards the anvil relative to the driving part 130.

The driving part 130 of the hammer has a radial bore 139 (FIG. 30) accommodating a locking member 140 projecting from this bore under the action of a spring 141. A radial bore 142 is also provided in the driven part 131 of the hammer opposite to the bore 139, and a pusher 143 in the form of a ball is located in this radial bore, this bore also receiving the projecting end of the locking member 140 so that the driven part 131 is prevented from axial displacement.

The pusher 143 projects from the radial bore 142 under the action of the locking member 140 as shown in FIG. 30.

Axial counterbores 144 and 145, respectively, are provided in the driving 130 and driven 131 parts of the hammer.

An axial bore 146 is provided in the driven part 131 of the hammer to accommodate the first part 15 of the device 14 for preliminary interaction of the hammer and anvil.

The first part 15 of the device 14 comprises an axially movable rod 147 having a flange 148 at one end thereof and a longitudinally extending recess 149 at the other end thereof adjacent to the anvil 5, as well as a lever 150 extending along the rod within the longitudinally extending recess 149 thereof. The lever 150 is articulated by means of a pivot 151 at the intermediate portion, and one arm 152 of the lever engages the pusher 143 projecting from the radial bore 142 in such a manner that the other arm projects from the longitudinally extending recess 149, the projection arm of the lever 150 having a projection 153 with a tapered portion 154 at the side facing the anvil 5.

The rod 147 is provided with an expansion ring 155 retaining the driven part 131 of the hammer, and the driven part 131 mates with the rod 147 along cylindrical surfaces 156.

The second part 16 of the device 14 for preliminary interaction of the hammer and anvil is disposed at the inner side of one of the impact jaws 7 of the anvil 5 and comprises a convex portion 157 (FIG. 32) with tapered surfaces 158. The tapered surfaces 158 and 154 of the portion 157 and projection 153, respectively, constitute the members engaging each other upon the displacement of the driven part 131 of the hammer towards the anvil 5, i.e. upon the displacement of the first part 15 of the device 14 towards its second part.

Since the tapered surfaces 258 are provided directly on one of the impact jaws 7 of the anvil 5, their predetermined angular positioning relative to the anvil jaws is automatically ensured in this case, and the predetermined angular positioning of the tapered surfaces 154 of the projection 153 relative to the impact jaws 6 of the driven part 131 of the hammer is achieved due to the lever 150 with the projection 153 beimg disposed opposite to one of the impact jaws 6 as shown in FIG. 33.

The mechanism for displacement of the first part 15 (FIG. 30) of the device 14 towards the second part 16 thereof comprises flyweights 159 mounted in a recess 160 of the driving part 130 of the hammer, the flange 148 of the rod 147 being received in the same recess.

The flyweights 159 are mounted for rocking motion on a pivot 161 fixed at 162 (FIG. 34) in the driving part 130 and engage tapered surfaces (FIG. 30) of the flange 148.

During rocking, the flyweights 159 cooperate with the flange 148 of the rod 147 for displacing the latter.

The device 12 for axial displacement of the driven part 131 of the hammer for engagement of the impact jaws 6 and 7 comprises a spring 164 disposed between the flange 148 of the rod 147 and the driven part 131 of the hammer in the counterbore 145.

The device 13 for disengagement of the impact jaws is disposed between the flange 148 of the rod 147 and the driving part pf the hammer in the counterbore 144 and comprises a return spring 165.

The above-described impact wrench operates as follows.

After placing the wrench on a bolt or nut to be tightened, the drive 8 is energized. The torque is transmitted, via the drive shaft 137 and friction clutch 136, to the driving part 130 of the hammer rotating together with the flyweights, 159, driven part 131 and rod 147. The rotation is transmitted to the rod 147 due to cooperation of the recess 160 with flats 166 (FIG. 34) of the flynge 148.

As the rotational speed increases, the flyweights 159 rotate about the pivot 161 under the action of centrifugal forces to act on the tapered surfaces 163 of the flange 148 and to displace the rod 147 towards the anvil 5. Thus, the springs 164 and 165 are compressed. This displacement occurs until the projection 153 of the lever 150 reaches the tapered surfaces 158 (FIG. 32) of the convex portion 157 of the impact jaw 7.

Upon engagement of the tapered portion 154 of the projection 153 with the tapered surface 158, the lever 150 is pivoted about the pivot 151 to force with the arm 152 thereof the pusher 143 into the radial bore 142 of the driven part 131 of the hammer.

The pusher 143, in turn, forces the locking member 140 into the bore 139, the ring 167 embracing the driving part 131 of the hammer preventing the locking member 140 from leaving the bore 139.

During the displacement of the locking member 140, the drive part 131 of the hammer is disengaged from the driving part 130 thereof.

Under the action of the spring 164, the driven part 131 of the hammer is displaced towards the anvil 5 for engagement of the impact jaws 6 and 7 over the entire height thereof, and the accumulated kinetic energy of the rotating masses is transmitted into a threaded fastener.

During the transmission of a blow, the driven part 131 and driving part 130 of the hammer are completely braked, and the springs 164 and 165 return the driven part 131 together with the rod 147, and the driving part 130, respectively, to the initial position, and the blows are repeated at regular intervals in the above-described sequence until the drive is deenergized.

In an impact wrench shown in FIG. 35 the housing 1 is made split with two handles 168 and 169 and with a switch 170. The drive 8 comprises an electric motor having a rotor 171 embracing a stator 172 mounted on a fixed axle 173. The hammer 4 of the wrench is made composite of a driving part 174 and a driven part 175. The driving part 174 is rigidly connected to the rotor 171 and journalled in bearings 176 and 177. The driven part 175 of the hammer is mounted in the driving part 174 for rotation together therewith and for relative axial displacement, and for that purpose their making surfaces define a hexagonal cross-section as shown in FIG. 36.

The first part 15 of the device 14 for preliminary interaction of the hammer and anvil comprises an axially movable sleeve 178 mounted between the fixed axle 173 and the driven part 175 of the hammer.

The sleeve 178 has radial bores 179 (FIG. 37) each accommodating a ball 180. The end of the sleeve 178 (FIG. 35) remote from the anvil 5 is provided with a flange 181 having a tapered surface 182 facing the electric motor.

The driving part 174 of the hammer has radially extending recesses 183 each having one side defined by the tapered surface 182 of the flange 181, and, in addition, radial bores 184 are provided in the driving part 174 of the hammer opposite to the radial bores 179 of the sleeve, each radial bore receiving a spring-loaded locking member 185. The locking members 185 cooperate with the balls 180 through pushers 186 (FIG. 38) mounted in radial bores 187 of the driven part 175 of the hammer which has an annular groove 188 (FIG. 35).

The second part 16 of the device 14 for preliminary interaction of the hammer and anvil comprises a tubular member 189 embracing the fixed axle 173 and mounted together therewith in an axial bore 190 of the anvil 5.

The tubular member 189 has axial projections 191 (FIGS. 39*a*, *b*, *c*) having tapered surfaces 192 and 193. The axial projections 191, as well as the balls 180 constitute the members engaging each other upon the displacement of the first part 15 of the device 14 towards the second part 16 thereof.

The mechanism for displacement of the first part 15 of the device 14 towards the second part 16 thereof comprises flyweights 194 in the form of balls received in the radially extending recesses 183 between the driving part 174 of the hammer and the tapered surface 182 of the flange 181.

The device 12 for axial displacement of the driving part 175 of the hammer towards the anvil for engagement of their impact jaws 6 and 7 comprises a spring 195 disposed betweens the flange 181 of the sleeve 178 and the driven part 175 of the hammer.

The device 13 for disengaging the impact jaws 6 and 7 comprises a return spring 196 disposed between the flange 181 of the sleeve 178 and an expansion ring 197 fixed to the driving part 174 of the hammer.

The axle 173 is provided with an axial bore 198 accommodating a switch 199 cooperating with a chamfered surface 200 of the sleeve 178, i.e. with the surface mating with the surface of the fixed axle 173.

The position of the sleeve 178 in the axial bore 190 of the anvil is fixed by means of a pin 201. The spindle 10 is journalled in a bushing 202 of the housing 1 and is integral with the anvil.

The above-described impact wrench operates as follows.

After connecting the impact wrench with a threaded fastener to be tightened, the switch 170 is actuated to energize the electric motor.

As the rotational speed of the rotor 171 and the driving part 174, driven part 175 of the hammer, the sleeve 178 and flyweights 194 increases, the flyweights 194 are displaced away from the axle 173 under the action of centrifugal forces to act on the tapered surfaces 182 of the flange 181. As a result, the sleeve 178 is displaced, together with the balls 180, towards the anvil 5 to compress the springs 195 and 196. This displacement will continue until the balls 180 FIG. 37) approach the axial projections 191 of the tubular member 189.

Upon the engagement of the balls 180 with the tapered surfaces 192 (FIG. 39*a*, *c*) or 193 of the axial projections 191, the balls 180 (FIG. 37) are forced into the annular groove 188 to act on the pushers 186 (FIG. 38) to displace them in the radial direction away from the axle 173 in the bores 187 and to act on the locking members 185 so as to force them into the bores 184 thereby disengaging the driven part 175 of the hammer from the driving part 174 thereof.

The driven part 175 of the hammer is displaced, under the action of the spring 195, towards the anvil for engagement of the impact jaws 6 and 7 of the hammer and anvil, and a blow is delivered to transmit the accumulated kinetic energy of the rotating masses into the threaded fastener. Prior to the transmission of a blow, as a result of cooperation of the chamfered surface 200 of the sleeve 178 with a pin 203 of the switch 199, the latter opens the power supply circuit of the electric motor so as to prevent it from operating under braking conditions during the blow transmission.

During the transmission of a blow, the rotating masses are completely braked. After the transmission of a blow the spring 196 returns the driven part 175 of the hammer and the sleeve 178 to the initial position, and the spring-loaded locking members 185 return the balls 180 into the radial bores 179 thereby connecting the driving part 174 of the hammer to the driven part 175 thereof and to the sleeve 178. During the return stroke of the sleeve 178, the switch 199 completes the electric motor circuit, and blows are repeated at regular intervals in the above-described sequence.

In the impact wrench shown in FIG. 40, the hammer is made composite and comprises a driving part formed by a hollow cylindrical body 204 and an annular member 205 rigidly fixed in the end of the cylindrical body remote from the anvil 5, as well as a driven part 206 with the impact jaws 6.

The cylindrical body 204 extends along the housing 1 and embraces the anvil 5, the ends of the cylindrical body being journalled in bearings 207 fixed in the housing 1.

The driven part 206 of the hammer is mounted in the cylindrical body 204 for axial displacement and for rotation together therewith, and for that purpose the annular member 205 has longitudinal slots 208, and the driven part 206 of the hammer has longitudinal splines 209 received in the slos 208 (FIG. 41).

The annular member 205 has radial recesses 210 each having one side defined by the driven part 206 of the hammer whose splines 209 have tapered portions 211.

The first part 15 of the device 14 for preliminary interaction of the hammer and anvil includes the driven part 206 of the hammer and an axially movable tubular member 212 mounted in axial bores of the driving and driven parts of the hammer. An expansion ring 213 retains the driven part 2;06 of the hammer on the tubular member 212.

The tubular member 212 is provided, at the end thereof facing the anvil 5, with axial projections 214 (FIG. 42), and at the other end thereof, with a shank 215 (FIG. 40) received in the axial bore of the annular member 205 and in a bore 216 of the shaft 9.

The intermediate portion of the tubular member 212 is provided with an annular shoulder 217, the tubular member 212 being urged towards the driving part of the hammer by means of a return spring 218 mounted in the bore 216.

The second part 16 of the device 14 for preliminary interaction of the hammer and anvil comprises an axially movable rod 219 with axial projections 220 facing the tubular member 212. The rod 219 is mounted in an axial bore 221 of the spindle 10 which is integral with the anvil 5. The rod 219 is urged towards the tubular member 212 by means of a spring 222 disposed under the rod 219 in the bore 221.

The rod 219 is connected to the spindle 10 for rotation togeyther therewith by means of a pin 223 which is fixed to the spindle and received in an elongate hole 224 of the rod 219.

The anvil 5 is provided with radial bores accommodating pushers 225 projecting outwards from the bores of the anvil 5, and the rod 219 has a diametrical bore 226 opposite to the pushers 225 of the spindle 10 for receiving locking members 227 comprising pins and a spring 228 mounted therebetween.

Tapered surfaces 229 are provided at the sides of the impact jaws 6 facing the rotational axis of the hammer for cooperation with the pushers 225.

The axial projections 220 and 214 of the rod 219 and tubular member 212, respectively, constitute the members engaging each other upon the displacement of the first part 15 of the device 14 towards the second part 16 thereof.

The mechanism for displacement of the first part 15 of the device 14 towards the second part 16 thereof comprises balls 230 disposed in the radial recesses 210 between the driven part 206 of the hammer and the annular member 205.

The device 12 for axial displacement of the driven part 206 of the hammer towards the anvil 5 for engagement of their impact jaws 6 and 7 comprises V-shaped grooves 231 (FIG. 43), and V-shaped recesses 232 which are made on the mating surfaces of the tubular member 212 and driven parrt 206 of the hammer, respectively, as well as balls 233 received in the grooves and recesses. The vertices of the V-shaped grooves 231 and recesses 232 are at the same angle to the impact jaws 6 of the hammer as the axial projections 214 (FIG. 40) of the tubular member 212.

The device 13 for disengagement of the impact jaws 6 and 7 comprises a return spring 218.

The spindle 10 is journalled in a bushing 234 of the housing 1.

The above-described impact wrench operates as follows.

After placing the impact wrench on a bolt or nut to be tightened, and after the drive has been energized, the driving and driven parts of the hammer start rotating together with the tubular member 212. After the hammer has gained a predetermined rotational speed, the balls 230 displacing under the action of centrifugal forces in the recesses 210 away from the rotational axis of the hammer will act on the tapered surfaces 211 of the splines 209 of the driven part 206 to displace it in the axial direction towards the anvil 5 together with the tubular member 212.

Thus, the balls 233 (FIG. 43) are displaced in the grooves 231 and recesses 232 and. Upon the displacement of the driven part 206 of the hammer at a certain distance, the tapered surfaces 229 of the impact jaws 6 will act on the pushers 225 which are forced into the bores of the anvil to cooperate with the locking members 227 to force them into the bores 226 of the rod 219. Thus, the rod 219 is displaced under the action of the spring 222 towards the tubular member 212 until the engagement of the axial projections 214 and 220. Complete engagement of the projections 214 and 220 is ensured due to a predetermined relative angular position of the projections 220 and the pushers 225 as well as projections 214 and tapered surfaces 229.

After the engagement of the rotating tubular member 212 with the stationary rod 219, the tubular member 212 is stopped and then starts moving towards the anvil 5 as a result of cooperation of the V-shaped grooves 231 and recesses 232 through the balls 233 to act through the annular shoulder 217 on the driven part 206 of the hammer so as to displace it for engagement of the impact jaws 6 and 7 of the hammer and anvil, and a blow is delivered with the kinetic energy of the accelerated masses being transmitted to the threaded fastener being tightened. During the displacement of the tubular member 212 towards the anvil 5 after the engagement thereof with the rod 219, the tubular member 212 causes the displacement of the rod 219 to the initial position, and the locking members 227 are partially received in the diametrical bore of the anvil 5 under the action of the spring 228 to return the pushers 225 to the initial position.

Since the driven part 206 of the hammer is completely braked during the blow transmission, the spring 218 while returning to the initial position, will rotate the tubular member 212 to displace the driven part 206 of the hammer to the initial position.

The balls 230 are returned to the initial position under the action of the tapered surfaces 211 of the splines 209.

Subsequently, blows are repeated at regular intervals in the above-described order until the drive is deenergized.

II. Impact wrenches in which the anvil 5 is displaced towards the hammer 4 for engagement of the impact jaws 6 and 7

Figure 1:
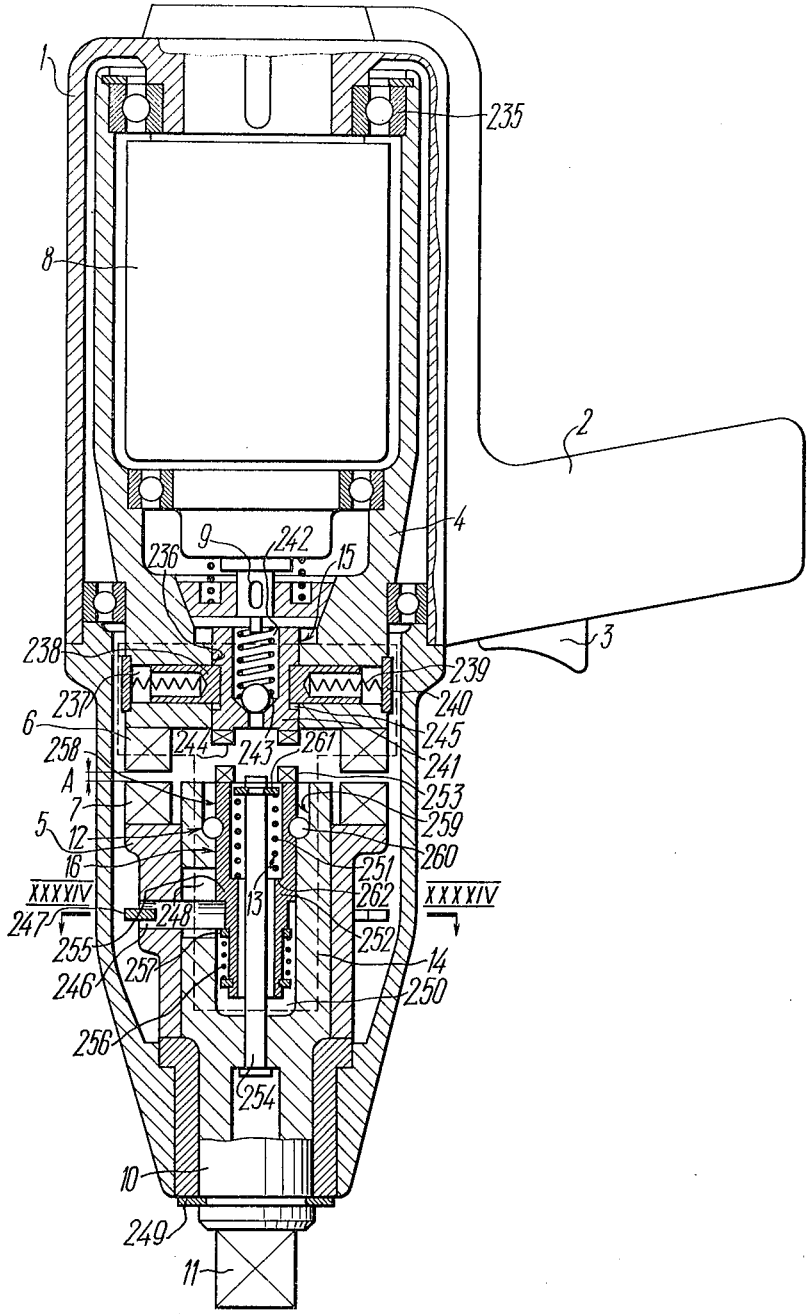
FIG. 1 is a schematic longitudinal section view of an impact wrench, according to the invention.

In the impact wrench shown in FIG. 1, the hammer 4 embraces the drive 8 and is journalled in the housing 1 in bearings 235. The hammer 4 has an axial bore 236 and radial bores 237 accommodating locking members 238 comprising flyweights urged towards the rotational axis ot the hammer 4 by means of springs 239 and retained in the bores 237 by means of a ring 240 embracing the hammer 4.

The first part 15 of the device for preliminary interaction of the hammer and anvil is disposed in the axial bore 236 of the hammer 4 for axial displacement relative thereto. This part 15 comprises a tubular member 241 having an axial bore 242 receiving a spring 243 urging the tubular member 241 towards the anvil 5 or towards the second part 16 of the device 14.

The tubular member 241 is provided, at the end thereof facing the anvil 5, with axial projections 244.

The tubular member 241 is prevented from axial displacement towards the anvil until the hammer gains a predetermined rotational speed by means of recesses 245 of the tubular member 241 receiving the ends of the locking members 238 projecting from the bores 237 of the hammer 4.

The anvil 5 is mounted on the spindle 10 for axial displacement relative thereto and for rotation together therewith, and for that purpose the mating surfaces of the anvil 5 and spindle 10 define a hexagonal cross-sectional (FIG. 44), the anvil 5 having radially inwardly directed projections 246 comprising pins retained in the anvil by means of a ring 247. The projections 246 pass through elongate holes 248 of the spindle 10.

The spindle 10 is journaleed in a fixed bearing of the housing 1 and is prevented from axial displacement by means of a retaining ring 249. The spindle 10 has axial bore 250 accommodating the second part 16 of the device 14 comprising a bush with axial projections 253 at the end thereof facing the first part 15 of the device 14, the bush being urged by a spring 251. The bush 252 is loosely mounted on an axle 254 extending in the axial bore 250 of the spindle 10 and has an annular shoulder 255 on the periphery thereof.

The projection 246 of the anvil 5 is urged against the shoulder 255 by means of a spring 256 through a washer 257 so as to connect the bush 252 to the anvil for their combined axial displacement towards the hammer.

Figure 19:
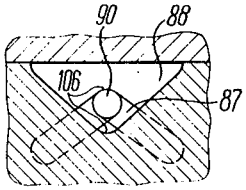
FIG. 19 is a sectional view taken along line XIX—XIX of FIG. 16.

The device 12 for axial displacement of the anvil is disposed between the spindle 10 and bush 252 and comprises V-shaped grooves 258 on the periphery of the bush, V-shaped recesses 259 on the inner surface of the spindle 10 and balls 260 received in the V-shaped grooves 258 and recesses 259, the V-shaped grooves and recesses being similar to those shown in FIGS. 19.

The device 13 for disengaging the impact jaws comprises a return spring 251 mounted between a shoulder 261 of the axle 254 and an internal annular shoulder 262 of the bush 252.

The axisl projections 244 of the tubular member 241 and the axial projections 253 of the bush 252 constitute the members of the parts 15 and 16 engaging each other.

The above-described impact wrench operates as follows.

The impact wrench is placed on a nut or bolt to be tightened, then the drive 8 is energized, and rotary motion is transmitted to the hammer. After the hammer has gained a predetermined rotational speed, the locking members 238 leave the recesses 245 of the tubular member 241 under the action of centrifugal forces to compress the spring 239. The tubular member is displaced under the action of the spring 243 in an axial direction towards the bush 252, and their axial projections 244 and 253 engage each other. Thus, the tubular member 241 rotating together with the hammer causes the rotation of the bush 252 which is displaced along a helical path due to the displacement of the balls 260 in the V-shaped grooves 258 and recesses 259. During the displacement of the bush 252 towards the hammer 4, first the spring 256 is compressed to relieve the inertial loads applied to the projections 246 of the anvil 5. After the compression of the spring 256, the washer 257 will act on the projections 246 to displace the anvil 5 along the hexagonal surface of the spindle 10 towards the hammer 4 to compress the spring 251. Upon the axial displacement of the anvil 5, its impact jaws 7 come into engagement with the impact jaws 6 of the hammer 4 over their entire height, and a blow is delivered with the kinetic energy of the hammer being transmitted to the threaded fastener being tightened through the spindle. At the instant of blow transmission, the hammer 4 is completely braked.

Concurrently with the displacement of the anvil 5, the bush 252 cooperates with the tubular member 241 to displace it in an axial direction to the initial position and to compress the spring 243, the locking members 238 being received in the recesses 245 under the action of the spring 239 so as to prevent the tubular member 241 from axial displacement. After the blow transmission, the spring 251 return the bush 252 and the anvil 5 to the initial position. Then blows are repeated at regular intervals in the above-described sequence until the drive is deenergized.

In the embodiments of the impact wrench shown in FIGS. 45 and 46, there are assemblies similar to those used in the embodiment shown in FIG. 1. These are the first part 15 of the device 14 comprising the tubular member 241 having the axial projections 244; the second part 16 of the device 14 comprising the bush 252 having the axial projections 253; the device 12 for axial displacement of the anvil 5 towards the hammer 4 for engagement of their impact jaws comprising the V-shaped grooves 258, V-shaped recesses 259 and the balls 260. The embodiments of the impact wrench shown in FIGS. 45, 46 have, however, some differences. Thus, the hammer 4 is made composite and comprises a hollow cylindrical body 263 awnd an annular member 264 fixed in the cylindrical body 263 and having impact jaws at the end thereof facing the anvil 5. The cylindrical body 263 extends along the rotational axis of the hammer and embraces the anvil 5, and the ends thereof are journalled in bearings 265.

The annular member 264 has an axial bore 266 accommodating the tubular member and radial bores 267 with the locking members 238 received in the recesses 245 of the tubular member to prevent the latter from axial displacement towards the anvil 5.

The bush 252 has a shank 268 received in the axial bore 250 of the spindle and an annular shoulder 269. The anvil 5 has a radial projection 270 facing the rotational axis of the hammer. A shock-absorbing spring 271 is disposed between the annular shoulder 269 and the projection 270.

At the end of the shank 268 there is provided a shoulder 272, and the device 13 for disengaging the impact jaws is disposed between the shoulder 272 of the shank and the spindle 10, said device comprising a return spring 273.

The spindle 10 is connected to the anvil 5 by means of longitudinally extending projection 274 of the anvil 5 (FIG. 47) and longitudinal slots of the spindle 10 receiving the projection 274 of the anvil.

In the impact wrench shown in FIG. 46, in addition to the locking members 238 (not shown), there are provided additional locking members.

The additional locking members comprise cylindrical rods 276 with a spring 277 mounted therebetween. The rods 276 are partially received in the longitudinally extending recesses 278 of the annular member 264 and in the longitudinally extending recesses 279 of the tubular member 241. The tubular member 241 has a diametrical bore 280 accommodating the spring 277 urging the rods 276 away from the rotational axis of the hammer.

The tubular member 241 is mounted in the axial bore of the annular member 264 by means of spherical keys 281 received in longitudinal keyways 282 on the periphery of the tubular member 241.

The angular length of the axial projections 244 and 253 of the tubular member 241 and bush 252, respectively, as well as the angular length of the impact jaws 6 and 7 of the hammer and anvil, respectively, are selected such that the axial projections 244 and 253 of the tubular member 241 and bush 252 engage each other through an angular distance ensuring their complete engagement.

The impact wrench shown in FIG. 45 operates similarly to that described with reference to FIG. 1.

The impact wrench shown in FIG. 46 also operates similarly to that shown in FIG. 1 with the difference that, after the displacement of the tubular member 241 towards the anvil 5, the axial projections 244 and 253 of the tubular member 241 and bush 252, respectively, engage each other through an angular distance $\alpha_{eng} = \alpha_3 - \alpha_2$ (FIG. 48) ensuring their complete engagement. This achieved due to a predetermined relative angular position and angular length of the axial projections 244 and 253 and the impact jaws 6 and 7.

If the displacement of the tubular member 241 towards the bush 252 occurs at the instant when the impact jaws 6 and 7 are located opposite to each other (in FIG. 48, the axial projections 244 and impact jaws 6 are shaded, the impact jaws 7 of the anvil 5 being conventionally shown of a larger size than the impact jaws 6 of the hammer 4), this displacement of the tubular member 241 towards the bush 252 will occur until the end faces of the rods 276 engage the end faces of the impact jaws 7 of the anvil 5 so that a small space remains between the axial projections 244 and 253 and they can move clear off each other.

As the hammer 4 continues to rotate with the tubular member 241, the rods 276 slide with their end faces over the end faces of the impact jaws 7 of the anvil 5. When the rods 276 leave the end faces of the impact jaws 7 after rotation of the hammer 4 (this position is shown with dotted line in FIG. 48), the tubular member 241 can continue its movement towards the bush 252. It should be noted, that due to the fact that the tubular member 241 rotates together with the hammer 4, the tubular member will engage with its projections 244 the axial projections 253 of the bush 252 after said rotation, the axial displacement of the tubular member 242 being interrupted until the end faces of the projections 244 slide over the end faces of the projections 253. It is only after this sliding moment, that the final displacement of the tubular member 241 towards the bush 252 begins, the engagement angle $\alpha_{eng.}$ providing for complete engagement of the projections 244 and 253.

If the initial displacement of the tubular member 241 towards the bush 252 occurs at the instant when the impact jaws 6 of the hammer 4 are not located oppositely to the hammer jaws 7 of the anvil, the projections 244 immediately slide over the projections 253 so that their engagement takes place again through the angular distance of $\alpha_{eng}$.

Subsequently, the bush 252 starts rotating together with the tubular member 241 and displacing along a helical path towards the anvil 4. Further operation of the impact wrench is similar to that of the embodiment described with reference to FIG. 1.

Various embodiments an impact wrench were described above incorporating an electric drive. It will be apparent to those skilled in the art that a pneumatic drive may also be used in the impact wrench according to the invention, in which case a friction clutch may be dispensed with.

What is claimed is:

1. An impact wrench comprising: a housing; a hammer mounted in said housing and having impact jaws; an anvil mounted in said housing and having impact jaws; said hammer and anvil being mounted coaxially in a space relationship and axially movable with respect to each other; a drive having an output shaft connected to said hammer for transmitting rotary motion thereto; a device for said relative axial displacement of said hammer and anvil for engagement of their jaws and for transmitting a blow to the anvil; a spindle journalled in said housing connected to said anvil for rotation together therewith, said spindle having means for receiving a socket wrench; a device for preliminary interaction of said hammer and anvil prior to the engagement of their impact jaws, said device having two parts axially movable relative to each other; the first part of said device for said preliminary interaction of said hammer and anvil being disposed in said hammer; the second part of said device for said preliminary interaction of said hammer and anvil being disposed in said anvil; members engaging each other upon relative displacement of said parts disposed on said parts and providing for said preliminary interaction of said hammer and anvil; said members of said first and second parts being at the same angle to said impact jaws of the hammer and anvil, respectively, whereby, upon said preliminary interaction of said hammer and anvil their impact jaws engage each other as they are mutually oriented; a device for disengaging the said impact jaws of the hammer and anvil.

2. An impact wrench comprising: a housing; an anvil mounted in said housing and having impact jaws and an axial bore; a hammer mounted in said housing coaxially with said anvil and made composite of a driving part and a driven part, said driven part having impact jaws arranged in a spaced relation said impact jaws of the anvil and is mounted for axial displacement towards said anvil; a drive having an output shaft connected, via a friction clutch, to the driving part of said hammer for transmitting rotary motion thereto, said output shaft being journalled in said axial bore of the anvil; said driven part of the hammer embracing said output shaft of the driven and being mounted in said driving part of the hammer for rotation together therewith; a device for said axial displacement of said driven part of the hammer towards said anvil for engagement of their impact jaws and for transmitting a blow to said anvil; a spindle journalled in said housing and connected to said anvil for rotation together therewith, said spindle having means for receiving a socket wrench; a device for preliminary interaction of said hammer and anvil prior to the engagement of their impact jaws, said device comprising two parts axially movable relative to each other; the first part of said device for said preliminary interaction of said hammer and anvil including said driven part of the hammer and being disposed in said hammer; the second part of said device for said preliminary interaction of said hammer and anvil being disposed in said anvil; members engaging each other upon said relative displacement of said parts disposed on said parts and providing for said preliminary interaction of said hammer and anvil; said members of said first and second parts being located at one and the same angle with respect to said impact jaws of the hammer and anvil respectively, whereby, upon said preliminary interaction of said hammer and anvil, their impact jaws engage each other as they are mutually oriented; a device for disengaging said impact jaws of the hammer and anvil.

3. An impact wrench comprising: a housing; an anvil mounted in said housing and having impact jaws and an axial bore; a hammer mounted in said housing coaxially with said anvil and made composite of a driving part and a driven part, said driven part being adapted for axial displacement towards said anvil; a drive having an output shaft connected, via a friction clutch, to said driving part of the hammer for transmitting rotary motion thereto, said output shaft being journalled in said axial bore of the anvil; said driven part of said hammer embracing said output shaft of the drive, being mounted in said driving part for rotation together therewith and spring-loaded with respect to said driving part; longitudinally extending recesses of rectangular cross-section in said driven part of the hammer open towards said output shaft of the drive; flyweights comprisng flat elongated members of rectangular cross-section mounted in said longitudinally extending recesses; each of said flyweights having two ends of which one end faces said anvil and the other end is remote from said anvil; impact jaws at the ends of said flyweights facing said anvil, said impact jaws being arranged in a spaced relationship with said impact jaws of the anvil; a tapered surface at the ends of the flyweights remote from said anvil; projections on said driven part of the hammer, said projections being directed radially inwardly towards said output shaft, and said flyweights bearing against said projections to retain said flyweights in said longitudinally extending recesses; a tapered surface on said driving part of the hammer facing said anvil, said tapered surfaces of said flyweights cooperating with said tapered surfaces of said driving part for displacement of said flyweights under the action of centrifugal forces developed during the rotation of said hammer; notches in said flyweights at the side facing said output shaft of the drive; said flyweights and said tapered surfaces of said driving part forming a device for said axial displacement of said driven part of the hammer towards said anvil for engagement of their impact jaws and for transmitting a blow to said anvil; a spindle journalled in said housing connected to said anvil for rotation together therewith, said spindle having means for receiving a socket wrench; a device for preliminary interaction of said hammer and anvil prior to the engagement of said impact jaws of the hammer and anvil, said device comprising two parts axially movable relative to each other; said parts having members engaging each other upon said relative displacement of said parts for effecting said preliminary interaction of said hammer and anvil; the first part of said device for said preliminary interaction of said hammer and anvil including said driven part of the hammer, said flyweights and projections provided on said impact jaws of the flyweights; a tapered surface on said projections of the flyweights; the second part of said device for said preliminary interaction of said hammer and anvil being disposed on the side of said impact jaws of the anvil facing said output shaft of the drive and comprising a cam surface; said cam surfaces and said tapered surfaces of said projections of the flyweights constituting said members of said first and second parts engaging each other upon relative displacement of said first part towards said second part, whereby said impact jaws of the hammer and anvil engage each other as they are mutually oriented; a bush spring-loaded with respect to said anvil and mounted on said output shaft of the drive; a flange of said bush, said flange being received in said notches of the flyweights and providing for concurrent engagement of said impact jaws of the flyweights with said impact jaws of the anvil; a device for disengaging said impact jaws of the hammer and anvil.

4. An impact wrench according to Claim 3, wherein said driving part of the hammer is provided at the end facing said anvil, with axial projections received in said longitudinally extending recesses of said driven part of the hammer, said tapered surface of said driven part of the hammer being provided on said projections.

5. An impact wrench comprising: a housing; an anvil mounted in said housing and having impact jaws and an axial bore; a hammer mounted in said housing coaxially with said anvil and made composite of a driving part and a driven part, said driven part having impact jaws arranged in a spaced relationship with said impact jaws of the anvil and adapted for axial displacement towards said anvil; a drive having an output shaft connected, via a friction clutch, to said driving part of the hammer for transmitting rotary motion thereto, said output shaft being journalled in said axial bore of the anvil; said driven part of the hammer embracing said output shaft of the drive and being mounted in said driving part of the hammer for rotation together therewith; a device for axial displacement of said driven part of the hammer towards said anvil for engagement of their impact jaws and for transmitting a blow to said anvil; a spindle journalled in said housing and connected to said anvil for rotation together therewith, said spindle having means for receiving a socket wrench; a device for preliminary interaction of said hammer and anvil prior to the engagement of said impact jaws of the hammer and anvil said device comprising two parts axially movable relative to each other said first and second parts having members engaging each other upon said relative displacement of said parts for effecting said preliminary interaction of said hammer and anvil; the first part of said device for said preliminary interaction of said hammer and anvil including said driven part of the hammer and being disposed in said hammer; the second part of said device for said preliminary interaction of said hammer and anvil being disposed in said anvil; said members of said first and second parts being at the same angle to said impact jaws of the hammer and anvil, respectively, whereby, upon said preliminary interaction of said hammer and anvil, their impact jaws engage each other as they are mutually oriented; a mechanism for axial displacement of said first part of said device for said preliminary interaction of said hammer and anvil towards said second part thereof, said mechanism being disposed between said driving part of the hammer and said first part of said device; a device for disengaging said impact jaws of the hammer and anvil.

6. An impact wrench comprising: a housing; an anvil mounted in said housing and having impact jaws and an axial bore; a hammer mounted in said housing coaxially with said anvil and made composite of a driving part and a driven part, said driven part being adapted for axial displacement towards said anvil; a drive having an output shaft connected, via a friction clutch, to said driving part of the hammer for transmitting rotary motion thereto, said output shaft being journalled in said axial bore of said anvil; said driven part of said hammer embracing said output shaft of the drive, being mounted in said driving part of the hammer for rotation together therewith and spring-loaded with respect to said driving part; an axial bore in said driven part of the hammer; radial bores in said driven part of said hammer; spring-loaded locking members mounted in said radial bores of said driven part of the hammer; longitudinally extending recesses in said driven part of the hammer; a spindle journalled in said housing and connected to said anvil for rotation together therewith, said spindle having means for receiving a socket wrench; a device for preliminary interaction of said hammer and anvil prior to the engagement of their impact jaws, said device comprising two parts axially movable relative to each other said first and second parts having members engaging each other upon said relative displacement of said parts for effecting said preliminary interaction of said hammer and anvil; the first part of said device for said preliminary interaction of said hammer and anvil including said driven part of the hammer and a sleeve mounted in said axial bore of said driven part of the hammer for rotation together therewith and for axial displacement relative thereto, said sleeve having two ends of which one end faces said anvil and the other end faces said driving part of the hammer; impact jaws provided at said end of the sleeve facing said anvil, said impact jaws being arranged in a spaced relationship with said impact jaws of the anvil; said sleeve being connected to said driven part of the hammer by means of said locking members, whereby said sleeve is prevented from axially displacing towards said anvil; radial bores in said sleeve provided opposite to said locking members said members of said first part comprising pushers mounted in said radial bores of the sleeve; a tapered surface at said end of the sleeve facing said driving part of the hammer; a tapered surface on said driving part of the hammer at the end thereof facing said sleeve; the second part of said device for said preliminary interaction of said hammer and anvil comprising a tubular member embracing said output shaft of the drive and fixed to said anvil; said members of said second part comprising axial projections of said tubular member axially disposed between said impact jaws of the hammer and anvil; a mechanism for displacement of said first part of said device for said preliminary interaction of said hammer and anvil towards said second part thereof, said mechanism comprising cylindrical rods extending in parallel with said output shaft in said longitudinally extending recesses of driven part of the hammer and bearing with their ends against said tapered surfaces of said hammer and sleeve, respectively; said axial projections of said tubular member and said pushers of the sleeve being at the same angle to said impact jaws of the anvil and hammer, respectively, whereby, upon said preliminary interaction of said hammer and anvil, their impact jaws engage each other as they are mutually oriented; said cylindrical rods moving along said tapered surfaces under the action of centrifugal forces developed during the rotation of said hammer thereby providing for the displacement of said driven part of the hammer and sleeve towards said anvil for engagement of said impact jaws of the hammer and anvil and for transmitting a blow to said anvil; a device for disengaging said impact jaws of the hammer and anvil.

7. An impact wrench according to Claim 6, wherein said device for disengaging said impact jaws of the hammer and anvil is disposed between said sleeve and said anvil and comprises a return spring embracing said tubular member, one end of said spring bearing against said anvil and the other end of said spring being received in a counterbore provided in the end wall of said sleeve facing said anvil.

8. An impact wrench comprising: a housing; an anvil mounted in said housing and having impact jaws and an axial bore; a hammer mounted in said housing coaxially with said anvil and made composite of a driving part and a driven part said driven part being adapted for axial displacement towards said anvil and has impact jaws arranged in a spaced relationship with said impact jaws of the anvil; a drive having an output shaft connected, via a friction clutch, to said driving part of the hammer for transmitting rotary motion thereto, said output shaft being journalled in said axial bore of said anvil; said driven part of said hammer embracing said output shaft of the drive and being mounted in said driving part for rotation together therewith; a tapered surface on said driven part of the hammer; radial bores in said driven part of the hammer; spring-loaded balls disposed in said radial bores of said driven part of the hammer; other radial bores in said driven part of said hammer; an annular groove in said driving part of the hammer opposite to said radial bores of said driven part of the hammer, said balls being partially received in said annular groove; a spindle journalled in said housing and connected to said anvil for rotation together therewith, said spindle having means for receiving a socket wrench; a device for preliminary interaction of said hammer and anvil prior to the engagement of their impact jaws, said device having two relatively parts axially movable relative to each other said parts having members engaging each other upon said relative displacement of said parts for effecting said preliminary interaction of said hammer and anvil; the first part of said device for said preliminary interaction of said hammer and anvil including said driven part of the hammer; said members of the first part comprising spring-loaded locking members mounted in said other radial bores of said driven part of the hammer; the second part of said device for said preliminary interaction of said hammer and anvil comprising an annular projection embracing said output shaft, said projection being disposed on said anvil; said members of the second part comprising axial cams made on said annular projection and axially disposed between said impact jaws of the anvil and said spring-loaded locking members; said locking members and said axial cams being at the same angle to said impact jaws of said hammer and anvil, respectively, whereby, upon said preliminary interaction of said hammer and anvil, their impact jaws engage each other as they are mutually oriented; a mechanism for displacement of said first part of said device for said preliminary interaction of said hammer and anvil towards said second part thereof comprising cyclindrical rods, one end of each rod bearing against said driving part of the hammer and the other end of each rod bearing against said tapered surface of said driven part of the hammer thereby providing for the displacement of said driven part of the hammer towards said anvil for engagement of said impact jaws thereof and for transmitting a blow to said anvil; a device for disengaging said impact jaws of said hammer and anvil.

9. An impact wrench comprising: a housing; an anvil mounted in said housing and having impact jaws and an axial bore; a hammer mounted in said housing coaxially with said anvil and made composite of a driving part and a driven part, said driven part being adapted for axial displacement towards said anvil and has impact jaws arranged in a spaced relationship with said impact jaws of the anvil; a drive having an output shaft connected to said driving part of the hammer for transmitting rotary motion thereto, said output shaft being journalled in said axial bore of said anvil; a friction clutch providing for said connection of said driving part of the hammer to said output shaft; said driven part of the hammer embracing said output shaft of the drive and being mounted in said driving part of the hammer for rotation together therewith; an axial bore in said driven part of said hammer; a spindle journalled in said housing and connected to said anvil for rotation together therewith, said spindle having means for receiving a socket wrench; a device for preliminary interaction of said hammer and anvil prior to the engagement of said impact jaws of the hammer and anvil, said device having two parts axially movable relative to each other; the first part of said device for said preliminary interaction of said hammer and anvil including said driven part of the hammer and an axially movable tubular member mounted in said axial bore of said driven part of hammer in such a manner that their peripheral surfaces engage each other; said tubular member embracing said output shaft of the drive; the second part of said device for said preliminary interaction of said hammer and anvil being disposed in said anvil; members of said first and second parts engaging each other upon said relative displacement of said parts providing for said preliminary interaction of said hammer and anvil; said members of said first and second parts being at the same angle to said impact jaws of the hammer and anvil, respectively, whereby, upon said preliminary interaction of said hammer and anvil their impact jaws engage each other as they are mutually oriented; a device for axial displacement of said driven part of the hammer towards said anvil for engagement of their impact jaws, said device being disposed between said tubular member and said driven part of the hammer and comprising V-shaped grooves and V-shaped recesses provided on said mating peripheral surfaces of said tubular member and said driven part of the hammer, respectively, and balls received in said V-shaped grooves and recesses, the vertices of said V-shaped grooves and recesses being at the same angle to said impact jaws of the hammer as said members of said first part of said device for said preliminary interaction of said hammer and anvil; a mechanism for axial displacement of said first part of said device for said preliminary interaction of said hammer and anvil towards said second part thereof; a device for disengaging said impact jaws of the hammer and anvil.

10. An impact wrench according to Claim 9, wherein said members of said first part comprise spring-loaded locking members mounted in said driven part of the hammer and preventing said tubular member from engaging said second part of said device for said preliminary interaction of said hammer and anvil, and axial projections of said tubular member provided at the end thereof facing said anvil, said tubular member having, at the other end thereof, a tapered surface; said second part of said device for said preliminary interaction of said hammer and anvil comprises an annular projection disposed on said anvil, said annular projection embracing said output shaft; said members of said second part comprising cams axially disposed between said impact jaws of the anvil and said locking members, and said mechanism for displacement of said first part of said device for said preliminary interaction of said hammer and anvil towards said second part thereof comprises balls disposed between said driving part of the hammer and said tapered surface of the tubular member.

11. An impact wrench according to Claim 9, wherein said second part of said device for said preliminary interaction of said hammer and anvil comprises an axially movable bush mounted in said axial bore of the anvil for rotation together therewith, said bush being permanently springly urged towards said hammer and having radial bores, said members of said second part comprising axial cams of said bush and spring-loaded locking members mounted in said radial bores; said members of said first part comprising axial projections of said tubular member for engaging said axial cams of said bush and tapered portion an the inner side of said impact jaws of the hammer for cooperation with said locking members, and said mechanism for displacement of said first part of said device for said preliminary interaction of said hammer and anvil comprises balls disposed between said driving part of the hammer and said driven part of the hammer.

12. An impact wrench according to Claim 10, wherein said device for disengaging said impact jaws of the hammer and anvil is disposed between said driven part of the hammer and said anvil and comprises a return spring embracing said output shaft of the drive.

13. An impact wrench comprising: a housing; an anvil mounted in said housing and having impact jaws; a hammer mounted coaxially with said anvil and made composite of a driven part and driving part; said driven part of the hammer being mounted in said driving part for rotation together therewith and for axial displacement towards said anvil, said driven part having impact jaws arranged in a spaced relationship with said impact jaws of the anvil; said driving part of the hammer comprising a hollow cylindrical body embracing said anvil; bearings fixed in said housing, said cylindrical body being journalled in said bearings; a radial bore in said cylindrical body; a spring-loaded locking member in said radial bore; a radial bore in said driven part of said hammer opposite to said radial bore of said cylindrical body, said locking member being partially received in said radial bore for retaining said driven part of the hammer within said driving part of the hammer; a pusher disposed in said radial bore of said driven part of the hammer, said pusher partially projecting therefrom under the action of said locking member; an axial bore in said driven part of said hammer; a drive having an output shaft connected to said driving part of the hammer for transmitting rotary motion thereto; a friction clutch connecting said output shaft to said driving part of the hammer; a spindle journalled in said housing and connected to said anvil for rotation together therewith, said spindle having means for receiving a socket wrench; a device for a preliminary interaction of said hammer and anvil prior to the engagement of their impact jaws, said device having two parts axially movable relative to each other said parts having members engaging each other upon said relative axial displacement of said parts for effecting said preliminary interaction of said hammer and anvil; the first part of said device for said preliminary interaction of said hammer and anvil comprising a rod and a lever; said rod having two ends and being axially movable in said axial bore of said driven part of the hammer; a flange provided at the end of said rod remote from said anvil; a longitudinally extending recess in said rod in the plane extending through said impact jaws of the hammer adjacent to the other end of the rod facing the anvil; said lever extending along said rod within said longitudinally extending recess thereof, being articulated thereto at the intermediate portion and having two arms; one arm of said lever engaging said pusher projecting from said radial bore of said driven part of the hammer in such a manner that the other arm of said lever projects from said longitudinally extending recess of the rod; said member of said first part comprising a projection of said arm of the lever projecting from said recess of the rod; a tapered portion of said projection at the side thereof facing the anvil; the second part of said device for said preliminary interaction of said hammer and anvil disposed at the side of one of said impact jaws of the anvil facing said output shaft, said second part comprising a convex portion; said member of said second part comprising tapered surfaces provided on said convex portion; a mechanism for displacement of said rod, said mechanism comprising rocking flyweights disposed in said driving part of the hammer and cooperating with said flange upon rocking under the action of centrifugal forces developed during the rotation of said hammer; a device for axial displacement of said driven part of the hammer for engagement of said impact jaws, said device comprising a spring disposed between said flange of the rod and said driven part of the hammer; a device for disengaging said impact jaws of the hammer and anvil, said device being disposed between said flange and said driving part of the hammer and comprising a return spring.

14. An impact wrench comprising: a housing; an anvil mounted in said housing and having an axial bore and impact jaws; a hammer mounted coaxially with said anvil and made composite of a driving part and a driven part; said driven part of the hammer being mounted in said driving part of the hammer for rotation together therewith and for axial displacement towards said anvil and having impact jaws arranged in a spaced relationship with said impact jaws of the anvil; radial bores in said driven part of the hammer; pushers mounted in said radial bores of said driven part of the hammer; a drive comprising an electric motor having a rotor embracing the stator, the rotor being rigidly connected to said driving part of the hammer and having radial bores; a fixed axle journalled in said axial bore of the anvil, said axle supporting said stator; a spindle journalled in said housing and connected to said anvil for rotation together therewith, said spindle having means for receiving a socket wrench; a device for preliminary interaction of said hammer and anvil prior to the engagement of their impact jaws, said device having two parts axially movable relative to each other said parts having members engaging each other upon said relative axial displacement for effecting said preliminary interaction of said hammer and anvil; the first part of said device for said preliminary interaction of said hammer and anvil comprising an axially movable sleeve mounted between said fixed axle and said driven part of the hammer; radial bores in said sleeve opposite to said radial bores of said driving part of the hammer; said members of said first part comprising balls received in said radial bores of the sleeve; a flange of said sleeve; a tapered surface of said flange facing said electric motor; spring-loaded locking members connecting said driving part of the hammer to said driven part of the hammer, said locking members being mounted in said radial bores of said driving part of the hammer opposite to said radial bores of the sleeve and cooperating with said balls through said pushers; the second part of said device for said preliminary interaction of said hammer and anvil comprising a tubular member fixed in said axial bore of the anvil and embracing said fixed axle; said members of said second part comprising axial projections of said tubular member; said axial projections and said balls being the same angle to said impact jaws of the hammer and anvil, respectively; a mechanism for displacement of said sleeve towards said tubular member, said mechanism being disposed between said driving part of the hammer and said tapered surface of the flange of said sleeve and comprising flyweights; a device for axial displacement of said driven part of the hammer for engagement of said impact jaws, said device comprising a spring disposed between said flange of the sleeve and said driven part of the hammer; a device for disengaging said impact jaws of the hammer and anvil, said device comprising a return spring disposed between said flange of the sleeve and said driving part of the hammer.

15. An impact wrench according to Claim 14, wherein there is provided a switch for deenergizing said electric motor prior to the engagement of said hammer and anvil, said switch being mounted in a bore of said fixed axle and cooperating with a chamfered surface of said sleeve facing said fixed axle.

16. An impact wrench comprising: a housing; a hammer mounted in said housing and having impact jaws; a spindle journalled in said housing and having means for receiving a socket wrench; an anvil having impact jaws disposed in a spaced relationship with said impact jaws of the hammer, said anvil being mounted on said spindle for rotation together therewith and for axial displacement towards said hammer for engagement of their impact jaws; an axial bore in said spindle; an axial bore in said hammer; a drive having an output shaft connected to said hammer for transmitting rotary motion thereto; a friction clutch connecting said output shaft to said hammer; a device for preliminary interaction of said hammer and anvil prior to the engagement of their impact jaws, said device having two parts axially movable relative to each other said parts having members engaging each other upon said relative axial displacement for effecting said preliminary interaction; the first part of said device for said preliminary interaction of said hammer and anvil comprising a tubular member urged by a spring towards said anvil; said members of said first part comprising axial projections of said tubular member at the end facing said anvil; said tubular member being mounted for axial displacement in said axial bore of the hammer; spring-loaded locking members retaining said tubular member in said axial bore of the hammer for rotation together therewith, said locking members preventing said tubular member from displacing towards said anvil until said hammer gains a predetermined rotational speed; the second part of said device for said preliminary interaction of said hammer and anvil comprising a spring-loaded bush mounted in said axial bore of the spindle; said bush being connected to said anvil for axial displacement together therewith towards said hammer; said members of said second part comprising axial projections at the end of said bush facing said tubular member; said axial projections being at the same angle to said impact jaws of the hammer and anvil, respectively, whereby, upon said preliminary interaction of said hammer and anvil, their impact jaws engage each other as they are mutually oriented; a device for axial displacement of said anvil towards said hammer for engagement of their impact jaws, said device being disposed between said spindle and said bush and comprising V-shaped grooves on the periphery of said bush, V-shaped recesses on the inner surface of said spindle and balls received in said V-shaped grooves and recesses; the vertices of said V-shaped grooves and recesses being at the same angle to said impact jaws of the anvil as said axial projections of the bush; a device for disengaging said impact jaws of the hammer and anvil.

17. An impact wrench according to Claim 16, wherein said locking members are mounted in radial bores of said hammer and comprises flyweights urged by springs towards the rotational axis of said hammer, the ends of said flyweights being received in recesses of said tubular member, said bush is loosely mounted on an axle journalled in said axial bore of the spindle and is provided with an annular shoulder on the periphery thereof, and said anvil is provided with radially inwardly directed projections cooperating with said annular shoulder of the bush, said spindle having elongated holes, said projections of the anvil passing through said holes, and said device for disengaging said impact jaws of the hammer and anvil comprises a return spring mounted between said axle and an internal annular shoulder of said bush.

18. An impact wrench according to Claim 17, wherein a shock-absorbing spring is provided between radial projections of said anvil and said bush.

19. An impact wrench according to Claim 16, wherein said hammer comprises a hollow cylindrical body extending along the rotational axis of said hammer and embracing said anvil, and an annular member rigidly fixed in said cylindrical body and having impact jaws at the end wall thereof facing said anvil, the ends of said cylindrical body being journalled in bearings fixed in said housing.

20. An impact wrench according to Claim 19, wherein said annular member has radial bores accommodating said locking members and an axial bore accommodating said tubular member, said bush has a shank received in said axial bore of the spindle, and said anvil has a radially inwardly directed annular projection and longitudinally extending projections, said spindle having longitudinally extending slots receiving said longitudinally extending projections of the anvil, and said device for disengaging said impact jaws of the hammer and anvil comprises a return spring mounted between said shank and said spindle.

21. An impact wrench according to Claim 20, wherein a shock-absorbing spring is mounted between said annular shoulder of said bush and said annular projection of said anvil.

22. An impact wrench according to Claim 17, wherein said tubular member has longitudinally extending slots on the periphery thereof which are in a predetermined angular relationship with said axial projections of the tubular member, and cylindrical rods mounted in said longitudinally extending slots urged outwards by a spring disposed in a diametrical bore of said tubular member, said rods engaging the inner surface of said annular member, the angular length of said axial projections of the tubular member and bush, as well as the angular length of said impact jaws of the hammer and anvil being selected in such a manner that said axial projections of the tubular member and bush engage each other through an anguler distance providing for their complete engagement.

23. An impact wrench comprising: a housing; an anvil mounted in said housing and having impact jaws; a spindle journalled in said housing and connected to said anvil for rotation together therewith, said spindle having means for receiving a socket wrench; a hammer mounted coaxially with said anvil and made composite of a driving part and a driven part; said driving part of the hammer comprising a hollow cylindrical body extending along the rotational axis of said hammer and embracing said anvil, and an annular member; bearings fixed in said housing, said cylindrical body being journalled in said bearings; said annular member being rigidly fixed in said cylindrical body at the end thereof remote from said anvil; said driven part of the hammer having impact jaws disposed in a spaced relationship with said impact jaws of the anvil, said driven part being axially movable in said cylindrical body and rotatable together therewith; an axial bore in said annular member of said driving part of the hammer; an axial bore in said spindle; radial bores in said anvil; tapered surfaces at the sides of said impact jaws of the hammer facing the rotational axis thereof; a drive having an output shaft connected to said annular member of the hammer for transmitting rotary motion thereto; a friction clutch connecting said output shaft to said annular member; a device for preliminary interaction of said hammer and anvil prior to the engagement of their impact jaws, said device comprising two parts axially movable relative to each other said parts having members engaging each other upon relative displacement for effecting said preliminary interaction of said hammer and anvil; the first part of said device for said preliminary interaction of said hammer and anvil including said driven part of said hammer and an axially movable tubular member mounted in said driven part of the hammer; said members of said first part comprising axial projections at the end of said tubular member facing said anvil; a shank at the other end of said tubular member received in said axial bore of said annular member; the second part of said device for said preliminary interaction of said hammer and anvil comprising an axially movable rod; said members of said second part comprising axial projections of said rod facing said tubular member; said rod being mounted in said axial bore of the spindle, urged by a spring towards said tubular member and connected to said spindle for rotation together therewith; a radial bore in said rod; spring-loaded locking members mounted in said radial bore of the rod, said locking members preventing said rod from axial displacement; pushers mounted in said radial bores of said anvil opposite to said locking members, said pushers cooperating with said tapered surfaces upon the displacement of said driven part of the hammer towards said anvil; said axial projections of the tubular member and rod being at the same angle to said impact jaws of the hammer and anvil, respectively, whereby, upon said preliminary interaction of said hammer and anvil, their impact jaws engage each other as they are mutually oriented; a mechanism for displacement of said first part of said device for said preliminary engagement of said hammer and anvil towards said second part thereof, said mechanism comprising balls disposed between said driven part of the hammer and said annular member; a device for axial displacement of said driven part of the hammer towards said anvil, said device comprising balls received in V-shaped grooves and V-shaped recess provided on the mating surfaces of said tubular member and said driven part of the hammer, respectively, the vertices of said V-shaped grooves and recesses being at the same angle to said impact of said hammer as said axial projections of said tubular member; a device for disengaging said impact jaws of the hammer and anvil, said device comprising a return spring disposed between said shank of the tubular member and said annular member of the hammer.

24. An impact wrench according to claim 23, wherein said rod has an elongate hole for receiving a pin fixed to said spindle.

* * * * *